US008353992B2

(12) United States Patent
Sugiura et al.

(10) Patent No.: US 8,353,992 B2
(45) Date of Patent: Jan. 15, 2013

(54) HIGH YOUNG'S MODULUS STEEL PLATE AND METHOD OF PRODUCTION OF SAME

(75) Inventors: Natsuko Sugiura, Tokyo (JP); Naoki Maruyama, Tokyo (JP); Manabu Takahashi, Tokyo (JP); Yohji Nakamura, Tokyo (JP); Koji Hanya, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 555 days.

(21) Appl. No.: 12/312,325

(22) PCT Filed: Nov. 7, 2007

(86) PCT No.: PCT/JP2007/072042

§ 371 (c)(1),
(2), (4) Date: May 4, 2009

(87) PCT Pub. No.: WO2008/056812

PCT Pub. Date: May 15, 2008

(65) Prior Publication Data

US 2010/0047617 A1 Feb. 25, 2010

(30) Foreign Application Priority Data

Nov. 7, 2006 (JP) ..... 2006-301354
Apr. 4, 2007 (JP) ..... 2007-098764
Nov. 6, 2007 (JP) ..... 2007-288960

(51) Int. Cl.

| | |
|---|---|
| ***C22C 38/14*** | (2006.01) |
| ***C22C 38/12*** | (2006.01) |
| ***C21D 38/02*** | (2006.01) |

(52) U.S. Cl. ..... 148/320; 148/332; 148/333; 148/334; 148/335; 148/336; 148/500; 148/504; 148/533; 148/602; 428/659

(58) Field of Classification Search ..... 148/320, 148/332–336, 533, 602, 500, 504; 420/126, 420/127; 428/659
See application file for complete search history.

(56) References Cited

FOREIGN PATENT DOCUMENTS

| | | |
|---|---|---|
| CA | 2 546 009 | 10/2005 |
| CA | 2 575 241 | 2/2006 |
| CN | 1840723 | 10/2006 |

(Continued)

OTHER PUBLICATIONS

International Search Report dated Feb. 19, 2008 issued in corresponding PCT Application No. PCT/JP2007/072042.

(Continued)

*Primary Examiner* — Deborah Yee
(74) *Attorney, Agent, or Firm* — Kenyon & Kenyon LLP

(57) ABSTRACT

Steel sheet having a composition of ingredients containing substantially, by mass %, C: 0.005 to 0.200%, Si: 2.50% or less, Mn: 0.10 to 3.00%, N: 0.0100% or less, Nb: 0.005 to 0.100%, and Ti: 0.002 to 0.150% and satisfying the relationship of Ti−48/14×N≧0.0005, having a sum of the X-ray random intensity ratios of the {100}<001> orientation and the {110}<001> orientation of a ⅙ sheet thickness part of 5 or less, having a sum of the maximum value of the X-ray random intensity ratios of the {110}<111> to {110}<112> orientation group and the X-ray random intensity ratios of the {211}<111> orientation of 5 or more, and having a high rolling direction Young's modulus measured by the static tension method and a method of production of the same are provided.

15 Claims, 2 Drawing Sheets

FOREIGN PATENT DOCUMENTS

| | | |
|---|---|---|
| EP | 1 568 791 | 8/2005 |
| JP | 04-147917 | 5/1992 |
| JP | 06-011503 | 1/1994 |
| JP | 2005-273001 | 10/2005 |
| JP | 2005-314793 | 11/2005 |
| JP | 2006-183130 | 7/2006 |
| JP | 2006-183131 | 7/2006 |
| JP | 2007-046146 | 2/2007 |
| JP | 2007-146275 | 6/2007 |

OTHER PUBLICATIONS

Canadian Office Action dated Apr. 13, 2011 issued in corresponding Canadian Application No. 2,668,987.

HIGH YOUNG'S MODULUS STEEL PLATE AND METHOD OF PRODUCTION OF SAME

TECHNICAL FIELD

The present invention relates to a high Young's modulus steel sheet and a method of production of the same.

BACKGROUND ART

The correlation of the Young's modulus and crystal orientation of iron is extremely strong. For example, the <111> orientation Young's modulus ideally is over 280 GPa, while the <110> orientation Young's modulus is about 220 GPa. On the other hand, the <100> orientation Young's modulus is about 130 GPa. The Young's modulus changes according to the crystal orientation. Further, when the crystal orientation of the steel material does not have orientation in any specific direction, that is, the texture is random, the Young's modulus of the steel sheet is about 205 GPa.

Up to now, a large number of technologies have been proposed regarding steel sheets controlling the texture to raise the Young's modulus in a direction perpendicular to the rolling direction (referred to as the "transverse direction"). Further, for technology for simultaneously raising the rolling direction and transverse direction Young's modulus of steel sheet, for example, Japanese Patent Publication (A) No. 4-147917 proposes a method of production of steel plate not only rolling in a certain direction, but also rolling in a direction perpendicular to this. This method of changing the direction of rolling in the middle can be performed relatively simply in the process of rolling steel plate.

However, even in the case of producing steel plate, depending on the width and length of the steel plate, it is sometimes necessary to make the rolling direction fixed. Further, in particular in the case of thin-gauge steel sheet, the sheet is often produced by the continuous hot rolling process of continuously rolling a steel slab to obtain a steel strip, so technology changing the rolling direction in the middle is not practical. Furthermore, the width of the thin-gauge steel sheet produced by the continuous hot rolling process is at most about 2 m. For this reason, for example, to apply a high Young's modulus steel sheet to a building material or other long member of over 2 m, it was necessary to raise the rolling direction Young's modulus.

To meet such demands, some of the inventors proposed the method of giving shear strain to the surface layer of a steel sheet part to raise the rolling direction Young's modulus of the surface layer part (for example, Japanese Patent Publication (A) No. 2005-273001, International Patent Publication No. 06-011503, Japanese Patent Publication (A) No. 2007-46146, and Japanese Patent Publication (A) No. 2007-146275).

The steel sheets obtained by the methods proposed in these patent documents have textures increasing the rolling direction Young's modulus at the surface layer part. For this reason, these steel sheets have high Young's moduli of the surface layer parts and have Young's moduli measured by the vibration method of over 230 GPa.

One method of measurement of the Young's modulus, that is, the vibration method, gives bending deformation to the steel sheet while changing the frequency, finds the frequency at which resonance occurs, and converts this to the Young's modulus. The Young's modulus measured by this method is also called the "dynamic Young's modulus". This is the Young's modulus obtained at the time of bending deformation. The contribution of the surface layer part with the large bending moment is great.

However, for example, when a load is applied to long beams or columns or other building materials or structural members of automobiles such as pillars or support members or other such long frame members, the stress acting on these is tensile stress and compressive stress and not bending stress. Further, automobile support members require a high impact absorption energy ability when receiving compressive deformation from the viewpoint of impact safety. For this reason, to improve the impact absorption energy of the member, it is necessary to secure the rigidity with respect to the tensile stress and compressive stress. In the face of such demands, it is effective to raise the Young's modulus in the longitudinal direction of the member with respect to the tensile stress and compressive stress.

Therefore, for the Young's modulus of the member on which this tensile stress and compressive stress act, it is extremely important to raise the Young's modulus measured by not the vibration method, but the static tension method, that is, the static Young's modulus. The static Young's modulus is the Young's modulus found from the inclination at the elastic deformation region of the stress-strain curve obtained at the time of the tensile test. It is the Young's modulus of the material as a whole determined by only the ratio of the thickness of the high Young's modulus layer and low layer.

To raise the rolling direction static Young's modulus, it is necessary to control the texture from the surface layer to a location deep in the plate thickness direction. Note that control of the texture of the entire sheet thickness from the surface layer to the sheet thickness center location is more preferable.

However, in the method proposed in these patent documents, it was difficult to introduce shear strain up to the center part of the plate thickness at the time of rolling. Further, depending on the ingredients and production conditions, in the texture of the sheet thickness center part, there is a possibility of a formation of orientation lowering the rolling direction Young's modulus.

For this reason, while the Young's modulus measured by the vibration method can be raised to 230 GPa or more, the Young's modulus measured by the static tension method is not necessarily high. That is, there has never been steel sheet with a rolling direction Young's modulus measured by the static tension method of 220 GPa or more.

DISCLOSURE OF THE INVENTION

The present invention provides high Young's modulus steel sheet with a high rolling direction Young's modulus where the longitudinal Young's modulus measured by the static tension method becomes 220 GPa or more when used for a building material or automobile member or other longitudinal member and a method of production of the same.

In this regard, the crystal orientation is usually shown by the expression {hkl}<uvw> where {hkl} indicates the sheet surface orientation and <uvw> indicates the rolling direction orientation. Therefore, to obtain a high Young's modulus in the rolling direction, it is necessary to control the operation so that the rolling direction orientation <uvw> matches with the high Young's modulus orientation as much as possible.

Based on this principle, the inventors engaged in studies for obtaining a high Young's modulus steel sheet with a rolling direction Young's modulus measured by the static tension method of 220 GPa or more.

As a result, the inventors newly discovered that to improve the rolling direction static Young's modulus, it is important to add Nb, include Ti and N in predetermined amounts, and suppress recrystallization in the austenite phase (below, called the "γ-phase") and, furthermore, if compositely adding B, the effect becomes remarkable and, further, that in hot rolling, the rolling temperature and the shape ratio found from the plate thickness at the entry side and exit side of the rolling rolls and the diameter of the rolling rolls are important and by controlling these to suitable ranges, the thickness of the layer given the shear strain at the surface of the steel sheet increases and the texture formed near the location of a distance from the surface in the sheet thickness direction of ⅙ the sheet thickness (called the "⅙ plate thickness part") also is optimized.

Further, there is correlation between the stacking fault energy affecting the deformation behavior of the γ-phase being hot worked and the texture after transformation. This affects the texture near the ⅙ sheet thickness part from the surface layer and the center part of the sheet thickness direction (called the "½ plate thickness part"). Therefore, to obtain a texture with an orientation where the rolling direction Young's modulus is improved at both the surface layer and sheet thickness center part, the inventors obtained the discovery that optimizing the relationship of the Mn, Mo, W, Ni, Cu, and Cr has an effect on the stacking fault energy of the γ-phase.

The present invention was made based on this discovery and has as its gist the following:

(1) High Young's modulus steel sheet containing, by mass %, C: 0.005 to 0.200%, Si: 2.50% or less, Mn: 0.10 to 3.00%, P: 0.150% or less, S: 0.0150% or less, Al: 0.150% or less, N: 0.0100% or less, Nb: 0.005 to 0.100%, and Ti: 0.002 to 0.150%, satisfying the formula 1, having a balance of Fe and unavoidable impurities, having a sum of an X-ray random intensity ratio of the {100}<001> orientation and an X-ray random intensity ratio of the {110}<001> orientation of 5 or less at a position of a direction from the surface of the steel sheet in the sheet thickness direction of ⅙ of the sheet thickness, and having a sum of a maximum value of the X-ray random intensity ratios of the {110}<111> to {110}<112> orientation group and a X-ray random intensity ratio of the {211}<111> orientation of 5 or more:

$$Ti-48/14\times N\geqq 0.0005 \qquad \text{formula 1}$$

where, Ti and N are the contents (mass %) of the elements (2) A high Young's modulus steel sheet as set forth in the above (1) characterized by satisfying the following formula 2:

$$4\leqq 3.2Mn+9.6Mo+4.7W+6.2Ni+18.6Cu+0.7Cr\leqq 10 \qquad \text{formula 2}$$

where, Mn, Mo, W, Ni, Cu, and Cr are the contents (mass %) of the elements (3) A high Young's modulus steel sheet as set forth in the above (1) or (2) characterized by further containing, by mass %, one or more of Mo: 0.01 to 1.00%, Cr: 0.01 to 3.00%, W: 0.01 to 3.00%, Cu: 0.01 to 3.00%, and Ni: 0.01 to 3.00%.

(4) A high Young's modulus steel sheet as set forth in any one of the above (1) to (3) characterized by further containing, by mass %, B: 0.0005 to 0.0100%.

(5) A high Young's modulus steel sheet as set forth in any one of the above (1) to (4) characterized by further containing, by mass %, one or more of Ca: 0.0005 to 0.1000%, Rem: 0.0005 to 0.1000%, and V: 0.001 to 0.100%.

(6) A high Young's modulus steel sheet as set forth in any one of the above (1) to (5) characterized by having an X-ray random intensity ratio of the {332}<113> orientation (A) of 15 or less and an X-ray random intensity ratio of the {225}<110> orientation (B) of 5 or more at a center part of the steel sheet in the sheet thickness direction and satisfying (A)/(B)≦1.00.

(7) A high Young's modulus steel sheet as set forth in any one of the above (1) to (6) characterized by having an X-ray random intensity ratio of the {332}<113> orientation (A) of 15 or less and a simple average of an X-ray random intensity ratio of the {001}<110> orientation and an X-ray random intensity ratio of the {112}<110> orientation (C) of 5 or more at a center part of the steel sheet in the sheet thickness direction and satisfying (A)/(C)≦1.10.

(8) A high Young's modulus steel sheet as set forth in any one of the above (1) to (7) characterized by having a rolling direction Young's modulus measured by the static tension method of 220 GPa or more.

(9) A hot dip galvanized steel sheet characterized by comprising a high Young's modulus steel plate as set forth in any one of the above (1) to (8) which is hot dip galvanized.

(10) A hot dip galvannealed steel sheet characterized by comprising a high Young's modulus steel sheet as set forth in any one of the above (1) to (8) which is hot dip galvannealed.

(11) A method of production of high Young's modulus steel sheet characterized by rolling a steel slab having the chemical ingredients as set forth in any of the above (1) to (5) at 1100° C. or less by a rolling rate until the final pass of 40% or more and by a shape ratio X found by the following formula 3 of 2.3 or more by two passes or more, hot rolling at a temperature of the final pass of the $Ar_3$ transformation point to 900° C., and coiling at 700° C. or less:

$$\text{Shape ratio } X=l_d/h_m \qquad \text{formula 3}$$

where, $l_d$ (contact arc length of rolling rolls and steel plate): $\sqrt{(L\times(h_{in}-h_{out})/2)}$ ld: $(h_{in}+h_{out})/2$ L: diameter of rolling rolls $h_{in}$: sheet thickness of rolling roll entry side $h_{out}$: sheet thickness of rolling roll exit side

(12) A method of production of high Young's modulus steel sheet as set forth in the above (11) characterized by hot rolling so that the effective strain ε* calculated by the following formula 5 becomes 0.4 or more:

$$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n \qquad \text{formula 5}$$

where, n is a number of rolling stands of final hot rolling, $\epsilon_j$ is a strain given at a j-th stand, $\epsilon_n$ is a strain given at an n-th stand, $t_i$ is a travel time (s) between an i-th to i+1st stands, and $\tau_i$ is calculated by the following formula 6 by a gas constant R (=1.987) and a rolling temperature $T_i$ (K) of an i-th stand:

$$\tau_i = 8.46\times 10^{-9}\exp\left(\frac{43800}{R\times Ti}\right) \qquad \text{formula 6}$$

(13) A method of production of high Young's modulus steel sheet as set forth in the above (11) or (12) characterized by making a differential peripheral speed rate of at least one pass of hot rolling 1% or more.

(14) A method of production of high Young's modulus steel sheet characterized by hot dip galvanizing a surface of steel sheet produced by the method as set forth in any of the above (11) to (13).

(15) A method of production of hot dip galvannealized steel sheet characterized by hot dip galvanizing a surface of steel sheet produced by a method as set forth in any of the above (11) to (13), then heat treating it in a temperature range from 450 to 600° C. for 10 seconds or more.

According to the above present invention, it is possible to obtain a high Young's modulus steel sheet improved in the rolling direction static Young's modulus measured by the static tension method.

BEST MODE FOR CARRYING OUT THE INVENTION

Figure 1:
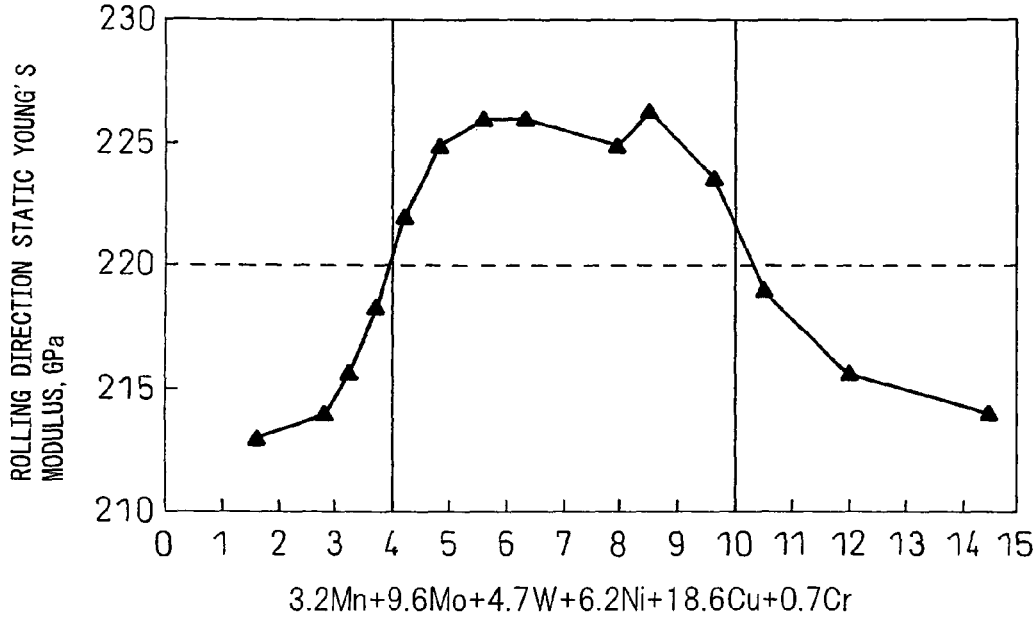
FIG. 1 is a view showing a relationship of a value of formula 2 of the present invention and a rolling direction static Young's modulus.

Texture changes in the plate thickness direction of steel sheet. When the texture differs at a surface layer and a center part of the sheet thickness direction, the rigidities, that is, the Young's moduli, in the tensile deformation and the bending deformation do not necessarily match. This is due to the fact that the rigidity in tensile deformation is a characteristic affected by the texture of the entire sheet thickness of the steel sheet and the rigidity in bending deformation is a characteristic affected by the texture of the surface layer of the steel plate part.

The present invention is steel sheet optimizing the texture down to a location of a distance from the surface in the sheet thickness direction of ⅙ of the sheet thickness and increasing the rolling direction Young's modulus.

Therefore, the texture contributing to the rolling direction Young's modulus is formed until at least a position deeper than the ⅛ plate thickness part, that is, the ⅙ plate thickness part. By increasing the thickness of the region of increased rolling direction Young's modulus, it is possible to increase the Young's modulus for not only bending deformation, but also tensile deformation and compressive deformation.

Further, to introduce shear strain to not only the surface layer, but also down to the ⅙ sheet thickness part, the plate is produced by raising the shape ratio determined by the sheet thickness before and after one pass of hot rolling and the diameter of the rolling rolls.

The steel sheet of the present invention concentrates the orientations raising the rolling direction Young's modulus from at least the surface layer to the ⅙ sheet thickness part and suppresses the concentration of orientations lowering the Young's modulus. The rolling direction static Young's modulus is high and the rigidity at the tensile deformation is high not only at the surface layer, but also down to the ⅙ sheet thickness part. Further, by concentrating the orientations raising the rolling direction Young's modulus at the location from the surface layer to the ⅙ plate thickness part, the concentration of orientations lowering the Young's modulus is also suppressed.

The steel sheet of the present invention specifically has a sum of the X-ray random intensity ratio of the {100}<001> orientation and the X-ray random intensity ratio of the {110}<001> orientation of the ⅙ sheet thickness part of 5 or less and has a sum of the maximum value of the X-ray random intensity ratios of the {110}<111> to {110}<112> orientation group and the X-ray random intensity ratio of the {112}<111> orientation of 5 or more. The steel sheet of the present invention is obtained by the action of shear force from the surface layer of the steel sheet to at least the ⅙ sheet thickness part in hot rolling.

To make the shear force of the hot rolling act down to the ⅙ sheet thickness part of the steel sheet, the inventors discovered that the shape ratio X defined by the following formula must be 2.3 or more at least at two passes among the total number of passes of hot rolling.

The shape ratio X, as shown by the following formula 3, is the ratio of the contact arc length of the rolls and steel and the average plate thickness. The inventors newly discovered that the larger the value of this shape ratio X, the deeper the part of the steel sheet in the sheet thickness direction at which the shear force acts.

$$\text{Shape ratio } X = l_d / h_m \qquad \text{formula 3}$$

where, $l_d$ (contact arc length of rolling rolls and steel plate): $\sqrt{(L \times (h_{in} - h_{out})/2)}$ ld: $(h_{in} + h_{out})/2$ L: diameter of rolling rolls $h_{in}$: sheet thickness at rolling roll entry side $h_{out}$: sheet thickness at rolling roll exit side With just one pass where the shape ratio X found by the following formula 3 is 2.3 or more, shear strain cannot be introduced down to the ⅙ sheet thickness part. For this reason, the thickness of the layer at which the shear strain was introduced (called "shear layer") is insufficient. The texture near the ⅙ sheet thickness part also deteriorates and the Young's modulus measured by the static tension method falls. Therefore, the number of passes where the shape ratio X is 2.3 or more has to be two passes or more.

The larger the number of passes, the better. The shape ratio X of all passes may also be made 2.3 or more. To increase the thickness of the shear layer, the larger the value of the shape ratio X the better. It is preferably 2.5 or more, more preferably 3.0 or more.

Further, if rolling the sheet at a shape ratio X of 2.3 or more at a high temperature, sometimes the subsequent recrystallization causes the texture raising the Young's modulus to be destroyed. For this reason, the rolling limiting the number of passes where the shape ratio X is made 2.3 or more has to be performed at 1100° C. or less.

Note that when rolling the sheet at 1100° C. or less, the formation of the {100}<001> orientation and {110}<001> orientation lowering the rolling direction Young's modulus is remarkable due to the introduction of the shear strain at a higher temperature. For this reason, to suppress the concentration of these orientations, it is preferable to suppress the shape ratio of the rolling at a high temperature. On the other hand, the formation of the {110}<111> to {110}<112> orientation group and {211}<111> orientation raising the rolling direction Young's modulus becomes remarkable by the introduction of shear strain at a low temperature. Therefore, the lower the rolling temperature, the more remarkable the effect of the shape ratio, so the rolling with a shape ratio X of 2.3 or more is preferably performed by a rolling stand near the end.

Furthermore, to optimize the texture of the total thickness from the surface to the center of sheet thickness, it is preferable to limit the ingredients to make the stacking fault energy of the austenite phase produced by the heating of the hot rolling (called the "γ-phase") the optimum range and perform rolling under conditions where the shear deformation becomes deep. Due to this, it is possible to suppress orientations lowering the Young's modulus from forming at the sheet thickness center part and raise the static Young's modulus of the sheet thickness as a whole.

The fact that difference in the stacking fault energy has a large effect on the working texture of the γ-phase having a face-centered cubic structure has been known before now. Further, when the γ-phase is worked during hot rolling, then is cooled and transformed to the ferrite phase (called the "α-phase"), the α-phase is transformed to an orientation having a certain relationship of orientation with the crystal orientation of the γ-phase before transformation. This is the phenomenon called "variant selection".

The inventors discovered that the change in the texture due to the strain introduced by the hot rolling is affected by the stacking fault energy of the γ-phase. That is, the texture changes due to the stacking fault energy of the γ-phase between the surface layer at which shear strain is introduced and the center layer at which compressive strain is introduced.

For example, if the stacking fault energy becomes higher, at the surface layer of the steel sheet part, the concentration of the orientation most raising the rolling direction Young's modulus, that is, the {110}<111> orientation, becomes higher and, at the plate thickness center part, the {332}<113> orientation lowering the rolling direction Young's modulus is developed. On the other hand, if the stacking fault energy falls, the concentration of the {110}<111> orientation will not rise from the surface layer to the ⅙ sheet thickness part. In particular, near the ⅙ sheet thickness part, the orientations lowering the Young's modulus, that is, {100}<001> and <110><001>, easily develop. As opposed to this, if the stacking fault energy falls, at the sheet thickness center part, orientations relatively advantageous to the rolling direction Young's modulus, that is, the {225}<110> orientation and the {001}110> orientation and {112}<110> orientation, form.

Therefore, to raise the static Young's modulus at both the surface layer and center part of the sheet thickness, it is necessary to control the stacking fault energy of the γ-phase to a suitable range. Specifically, preferably the following formula 2 is satisfied:

$$4 \leqq 3.2Mn+9.6Mo+4.7W+6.2Ni+18.6Cu+0.7Cr \leqq 10 \qquad \text{formula 2}$$

where Mn, Mo, W, Ni, Cu, and Cr are the contents (mass %) of the elements.

The above formula 2 is based on the formula converting the effects of the elements on the stacking fault energy of austenite-based stainless steel having a γ-phase to numerical values and modified by tests and further studies by the inventors. Specifically, the inventors investigated the rolling direction static Young's modulus in the case of making 0.03% C-0.1% Si-0.5% Mn-0.01% P-0.0012% S-0.036% Al-0.010% Nb-0.015% Ti-0.0012% B-0.0015% N the basic composition of ingredients and changing the amounts of addition of Mn, Cr, W, Cu, and Ni in various ways.

The hot rolling is performed at a temperature of the final pass of the $Ar_3$ transformation point to 900° C., a rolling rate from 1100° C. to the final pass of 40% or more, and a shape ratio of 2.3 or more for two passes or more. Note that the $Ar_3$ transformation temperature is calculated by the following formula 4:

$$Ar_3=901-325\times C+33\times Si+287\times P+40\times Al-92\times(Mn+Mo+Cu)-46\times(Cr+Ni) \qquad \text{formula 4}$$

where C, Si, P, Al, Mn, Mo, Cu, Cr, and Ni are the contents of the elements (mass %), a content of an extent of an impurity being indicated as "0". Further, to simulate the coiling at 700° C. or less after rolling, the sheet is heat treated by holding it at 650° C. for 2 hours.

From the steel sheet, a JIS Z 2201 No. 13 test piece was taken using the rolling direction as the longitudinal orientation. A tensile stress equivalent to ½ of the yield strength of the steel sheet was given and the static Young's modulus was measured. The measurement was conducted five times. The average value of the three measurement values minus the largest value and smallest value among the Young's moduli calculated based on the slant of the stress-strain graph was made the Young's modulus by the static tension method.

The results are shown in FIG. 1. From this, it is learned that when the value of this relationship discovered by the inventors is 4 to 10, a high rolling direction static Young's modulus of over 220 GPa is obtained, while if under 4 or over 10, the value remarkably falls.

Below, the X-ray random intensity ratio and the Young's modulus of the steel sheet of the present invention will be explained.

Sum of X-ray random intensity ratio of {100}<001> orientation and X-ray random intensity ratio of {110}<001> orientation at ⅙ plate thickness part:

The {100}<001> orientation and {110}<001> orientation are orientations remarkably lowering the rolling direction Young's modulus. When using the vibration method to measure the Young's modulus of the steel sheet, the effect of the texture of the surface layer is the greatest. The effect of the texture is small at the inside in the sheet thickness direction. However, when using the static tension method to measure the Young's modulus of the steel sheet, the texture of not only the surface layer, but also the texture at the inside in the sheet thickness direction has an effect.

To raise the Young's modulus measured by the tension method, it is necessary to raise the Young's modulus from at least the surface layer to the ⅙ sheet thickness part. Therefore, to raise the rolling direction Young's modulus measured by the tension method, the sum of the X-ray random intensity ratio of the {100}<001> orientation and the X-ray random intensity ratio of the {110}<001> orientation of the ⅙ sheet thickness part has to be made 5 or less. From this viewpoint, 3 or less is more preferable.

Note that the {100}<001> orientation and {110}<001> orientation easily form near the ⅙ sheet thickness part when only the surface layer of the steel sheet is given shear strain. On the other hand, if only shear strain is introduced down to near the ⅙ sheet thickness part, the formation of the {100}<001> orientation and {110}<001> orientation at this location is suppressed and the {110}<111> to {110}<112> orientation group and {211}<111> orientation explained below form.

Sum of maximum value of X-ray random intensity ratios of {110}<111> to {110}<112> orientation group and X-ray random intensity ratio of {211}<111> orientation at ⅙ sheet thickness part:

These are crystal orientations effective for raising the rolling direction Young's modulus and form due to the shear strain introduced at the time of hot rolling. The sum of the maximum value of the X-ray random intensity ratios of the {110}<111> to {110}<112> orientation group and the X-ray random intensity ratio of the {211}<111> orientation at the ⅙ sheet thickness part being 5 or more means that a texture raising the rolling direction Young's modulus has formed from the surface of the steel sheet down to the ⅙ sheet thickness part. Due to this, the rolling direction static Young's modulus measured by the tension method becomes 220 GPa or more. Preferably it is 10 or more, more preferably 12 or more.

The X-ray random intensity ratios of the {100}<001> orientation, {110}<001> orientation, and {110}<111> to {110}<112> orientation group and the {211}<111> orientation may be found from the crystal orientation distribution function (ODF) showing the three-dimensional texture calculated by the series expansion method based on a plurality of pole figures among the {110}, {100}, {211}, and {310} pole figures measured by the X-ray diffraction.

Note that the "X-ray random intensity ratio" is the value obtained by measuring the X-ray intensities of a standard sample not having concentration in a specific orientation and a test sample under the same conditions by the X-ray diffraction method etc. and dividing the obtained X-ray intensity of the test sample by the X-ray intensity of the standard sample.

Figure 2:
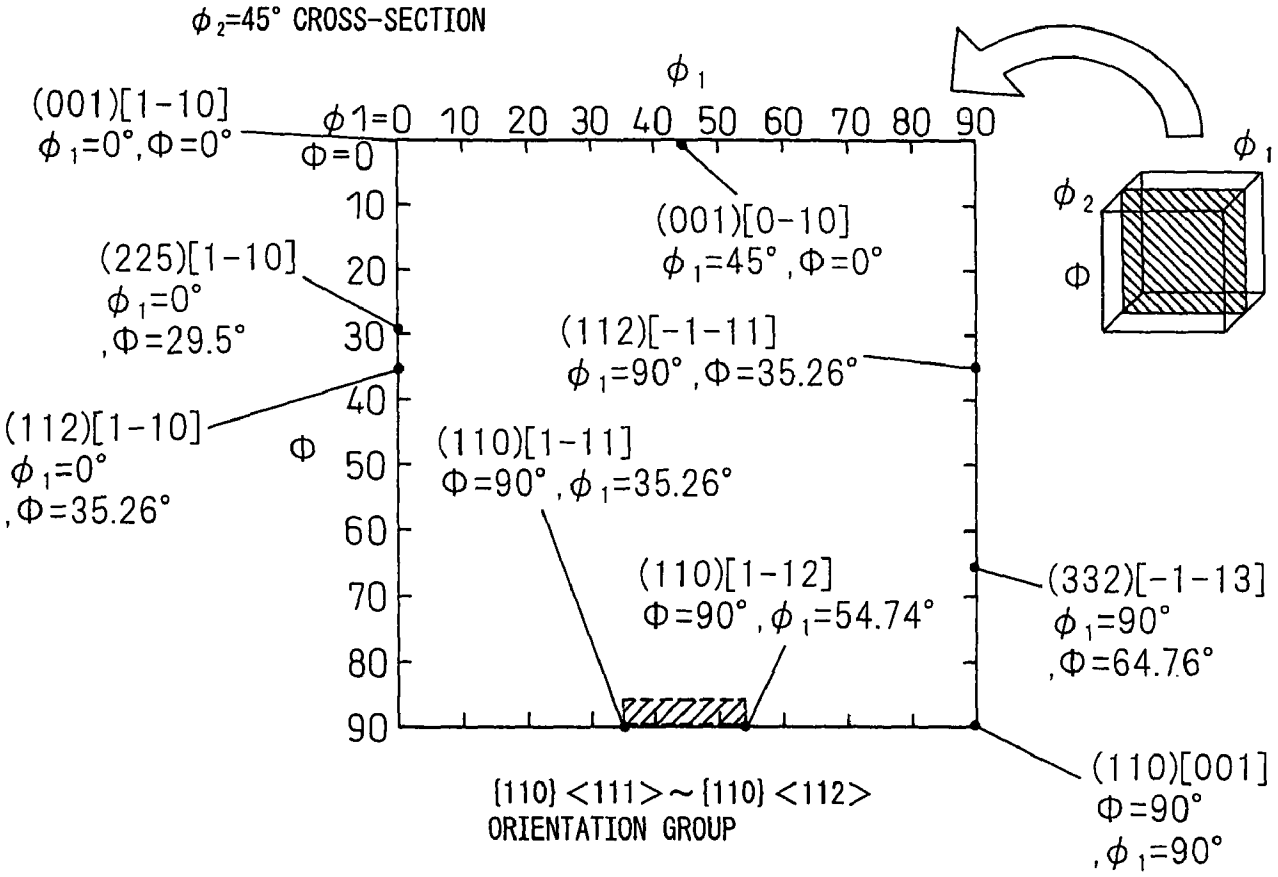
FIG. 2 is a view showing a crystal orientation distribution function (ODF) at a Euler angle $\phi_2$=45° cross-section and a main orientation.

FIG. 2 shows the ODF of the $\phi_2$=45° cross-section by which the crystal orientations of the present invention are expressed. FIG. 2 is a Bunge expression showing the three-dimensional texture by a crystal orientation distribution function. The Euler angle $\phi_2$ is made 45° and the specific crystal orientation (hkl)[uvw] is shown by the Euler angles $\phi_1$, Φ of the crystal orientation distribution function. As shown by the points on the axis of Φ=90° of FIG. 2, the {110}<111> to {110}<112> orientation group strictly speaking indicates the range of Φ=90° and $\phi_1$=35.26 to 54.74°. However, sometimes measurement error occurs due to the working of the test sample or the setting of the sample, so the maximum value of the X-ray random intensity ratios of the {110}<111> to {110}<112> orientation group is made the maximum X-ray random intensity ratio in the range of Φ=85 to 90° and $\phi_1$=35 to 550 shown by the hatching in the figure.

Due to similar reasons, at the $\phi_2$=45° cross-section of the three-dimensional texture, about the positions shown by the points of FIG. 2, the maximum values of the {211}<111> orientation in the range of $\phi_1$=85 to 90° and Φ=30 to 40°, the {100}<001> orientation in the range of $\phi_1$=40 to 50° and Φ=0 to 5°, and the {110}<001> orientation in the range of $\phi_1$=85 to 90° and Φ=85 to 90° are made the intensity ratios of those orientations.

Here, for the crystal orientation, usually the orientation vertical to the sheet surface is expressed as [hkl] or {hkl} and the orientation parallel to the rolling direction is expressed by (uvw) or <uvw>. {hkl} and <uvw> are general terms for equivalent surfaces, while [hkl] and (uvw) indicate individual crystal surfaces. That is, in the present invention, the body-centered cubic structure (referred to as the "b.c.c. structure") is covered, so for example the (111), (−111), (1-11), (11-1), (−1-11), (−11-1), (1-1-1), and (−1-1-1) surfaces are equivalent and cannot be distinguished. In this case, these orientations are referred to all together as "{111}".

Note that the ODF is used for showing the orientations of the low symmetric crystal structure, so in general is expressed by $\phi_1$=0 to 360°, (=0 to 180°, $\phi_2$=0 to 360°. The individual orientations are shown by [hkl](uvw). However, in the present invention, since the highly symmetric b.c.c. structure is covered, Φ and $\phi_2$ are expressed in the range of 0 to 90°. Further, at the time of calculation of $\phi_1$, the range changes depending on whether considering the symmetry due to deformation. In the present invention, symmetry is considered and $\phi_1$ is expressed as $\phi_1$=0 to 90°, that is, the average value of the same orientation in the range of $\phi_1$=0 to 360° is expressed on the 0 to 90° ODF. In this case, [hkl] (uvw) and {hkl}<uvw> are synonymous. Therefore, for example, the X-ray random intensity ratio of (110)[1-11] of the ODF at the $\phi_2$=45° cross-section shown in FIG. 2 is the X-ray random intensity ratio of the {110}<111> orientation.

The samples for X-ray diffraction may be prepared as follows:

The steel sheet is polished and buffed by mechanical polishing, chemical polishing, etc. to a predetermined position in the sheet thickness direction to a mirror surface, then is polished by electrolytic polishing or chemical polishing to remove the strain and simultaneously adjust the plate so that the ⅙ sheet thickness part becomes the measurement surface.

Note that making the measurement surface precisely the ⅙ sheet thickness part is difficult, so it is sufficient to prepare the sample so that the measurement surface becomes within a range of 3% of the sheet thickness from the targeted position. Further, in the case where measurement by X-ray diffraction is difficult, the EBSP (Electron Back Scattering Pattern) method and ECP (Electron Channeling Pattern) method may be used to measure statistically sufficient values.

If suppressing the formation of the {100}001> orientation and {110}<001> orientation down to a deeper position in the sheet thickness direction and forming the {110}<111> to {110}<112> orientation group and {211}<111> orientation, the Young's modulus is further improved. For this reason, by making the texture the same as the surface layer down to a position deeper than the ⅙ sheet thickness part, preferably down to the ¼ sheet thickness part, more preferably down to the ⅓ sheet thickness part, the rolling direction static Young's modulus is remarkably improved.

However, even if shear strain is introduced from the surface layer down to a position deeper than usual like in the present invention, introduction of the shear strain at the sheet thickness center part is impossible. For this reason, it is not possible to form a texture the same as the surface layer at the ½ sheet thickness part and a texture different from the surface layer forms at the sheet thickness center layer.

Therefore, furthermore, to improve the static Young's modulus, it is preferable to improve not only the texture from the surface layer to the ⅙ sheet thickness part, but also the texture of the ½ sheet thickness part to an orientation advantageous to the rolling direction Young's modulus.

X-ray random intensity ratio of {332}<113> orientation (A) and X-ray random intensity ratio of {225}<110> orientation (B) at sheet thickness center part and (A)/(B):

The {332}<113> orientation is a representative crystal orientation forming at the sheet thickness center part and is an orientation lowering the rolling direction Young's modulus, while the {225}<110> orientation is a relatively advantageous orientation for the rolling direction Young's modulus.

Therefore, to improve the static Young's modulus of the rolling direction of the sheet thickness center part, it is preferable that the X-ray random intensity ratio of the {332}<113> orientation (A) at the sheet thickness center part be 15 or less and the X-ray random intensity ratio of the {225}<110> orientation (B) be 5 or more. In addition, it is preferable that the orientation lowering the rolling direction Young's modulus (A) be made equal to or less than the orientation raising the rolling direction Young's modulus (B), specifically, that (A)/(B) be 1.00 or less. From this viewpoint, (A)/(B) is preferably made 0.75 or less, more preferably 0.60 or less. By satisfying the above condition, it is possible to make the difference of the dynamic Young's modulus and static Young's modulus within 10 GPa.

Average of X-ray random intensity ratios of {001}<110> orientation and {112} 110> orientation at sheet thickness center part (C) and (A)/(C):

To make the rolling direction static Young's modulus 220 GPa or more, it is preferable to control the rolled texture formed at the sheet thickness center part and make the rolling direction Young's modulus at this part a value of 215 GPa.

The {001}<110> orientation and the {112}<110> orientation are representative orientations where the <110> orientation matches the rolling direction called the "α-fiber". This orientation is a comparatively advantageous orientation for the rolling direction Young's modulus. To improve the rolling direction static Young's modulus of the sheet thickness center part, it is preferable that the simple average value (C) of the X-ray random intensity ratios of the {001}<110> orientation and the {112}<110> orientation at the sheet thickness center part satisfy 5 or more. In addition, it is preferable that the orientation lowering the rolling direction Young's modulus (A) be made equal to or lower than the orientation raising the rolling direction Young's modulus (C), specifically, (A)/(C) be made 1.10 or less.

The sample for X-ray diffraction at the ½ sheet thickness part may also be prepared, in the same way as the sample of the ⅙ sheet thickness part, by polishing to remove the strain to adjust the sample so that a range within 3% of the ½ sheet thickness part becomes the measurement surface. Note that when segregation or another abnormality is recognized at the sheet thickness center part, it is preferable to prepare the sample avoiding the segregated part in the range of 7/16 to 9/16 of the sheet thickness.

However, in the same way as the ⅙ sheet thickness part, measurement error due to working of the test piece or setting of the sample sometimes occurs. For this reason, in the $\phi_2$=45° cross-section of the three-dimensional texture shown in FIG. 2, the maximum values of the {001}<110> orientation and the {225}<110> orientation in the $\phi_1$=0 to 5° and Φ=0 to 5° range and the $\phi_1$=0 to 5° and Φ=25 to 35° range and of the {332}<113> orientation in the $\phi_1$=85 to 90° and Φ=60 to 70° range can be used to represent the intensity ratios of those orientations. Further, the {112}<110> orientation is made the $\phi_1$=0 to 5° and Φ=30 to 40° range. For this reason, for example, at $\phi_1$=0 to 5°, when the maximum value in the range of Φ=30 to 35° becomes larger than Φ=25 to 30° and Φ=35 to 40°, the X-ray random intensity ratio of the {225}<110> orientation and the X-ray random intensity ratio of the {112}<110> orientation are evaluated as the same numerical value.

The Young's modulus is measured by the static tension method by using a tensile test piece based on JIS Z 2201 and imparting a tensile stress equivalent to ½ of the yield strength of the steel sheet. That is, the Young's modulus is calculated based on not only the tensile stress equivalent to ½ of the yield strength, but also the slant of the obtained stress-strain graph. To eliminate the variations in measurement, the same test piece is used for measurement five times and the average value of the three measurement methods minus the largest value and smallest value among the results obtained is made the Young's modulus.

Below, the reasons for limiting the steel composition in the present invention will be explained further.

Nb is an important element in the present invention. In hot rolling, it remarkably suppresses the recrystallization at the time of working the γ-phase and remarkably promotes the formation of the working texture at the γ-phase. From this viewpoint, addition of Nb in an amount of 0.005% or more is necessary. Further, addition of 0.010% or more is preferable and addition of 0.015% or more or more preferable. However, if the amount of addition of Nb exceeds 0.100%, the rolling direction Young's modulus falls, so the upper limit is made 0.100%. The reason why the addition of Nb results in a drop in the rolling direction Young's modulus is not certain, but it is guessed that the Nb has an effect on the stacking fault energy of the γ-phase. From this viewpoint, it is preferable to make the amount of addition of Nb 0.080% or less, more preferably 0.060% or less.

Ti is also an important element in the present invention. Ti forms nitrides in the γ-phase high temperature region and suppresses recrystallization at the time of working the γ-phase in hot rolling. Furthermore, when adding B, due to the formation of nitrides of Ti, the precipitation of BN is suppressed, so the solid solute B can be secured. Due to this, formation of a texture preferable for improvement of the Young's modulus is promoted. To obtain this effect, Ti has to be added in an amount of 0.002% or more. On the other hand, if adding Ti over 0.150%, the workability remarkably deteriorates, so this value is made the upper limit. From this viewpoint, it is preferably made 0.100% or less. More preferably it is 0.060% or less.

N is an impurity. The lower limit is not particularly set, but making it less than 0.0005% results in higher costs, but not that great an effect is obtained, so the content is made 0.0005% or more. Further, N forms a nitride with Ti and suppresses recrystallization of the γ-phase, so may be deliberately added, but it reduces the effect of suppression of recrystallization of B, so is suppressed to 0.0100% or less. From this viewpoint, it is preferably 0.0050% or less, more preferably 0.0020% or less.

Furthermore, Ti and N have to satisfy the following formula 1:

$$Ti-48/14\times N \geqq 0.0005 \qquad \text{formula 1}$$

Due to this, the effect of suppression of recrystallization of the γ-phase due to precipitation of TiN is exhibited, the formation of BN in the case of addition of B can be suppressed, and the formation of texture preferable for improvement of the Young's modulus is promoted.

C is an element increasing the strength. Addition of 0.005% or more is necessary. Further, from the viewpoint of the Young's modulus, the lower limit of the amount of C is preferably made 0.010% or more. This is because if the amount of C falls to less than 0.010%, the $Ar_3$ transformation temperature rises, the hot rolling at a low temperature becomes difficult, and the Young's modulus falls. Furthermore, to suppress the fatigue characteristics of the weld zone, the content is preferably made 0.020% or more. On the other hand, if the amount of C exceeds 0.200%, the shapeability deteriorates, so the upper limit was made 0.200%. Further, if the amount of C exceeds 0.100%, the weldability is sometimes impaired, so it is preferable to make the amount of C 0.100% or less. Further, if the amount of C exceeds 0.060%, the rolling direction Young's modulus sometimes falls, so 0.060% or less is more preferable.

Si is a deoxidizing element. The lower limit is not defined, but making it less than 0.001% results in higher production costs. Further, Si is an element increasing the strength by solution strengthening. This is also effective for obtaining a structure including martensite, bainite, or further residual austenite. For this reason, it may be deliberately added in accordance with the targeted strength level, but if the amount of addition exceeds 2.50%, the press formability deteriorates, so 2.50% is made the upper limit. Further, if the amount of Si is large, the chemical convertibility falls, so the amount is preferably made 1.20% or less. Furthermore, when performing hot dip galvanization, the drop in plating adhesion, the drop in productivity due to the delay in the alloying reaction, and other problems sometimes arise, so the amount of Si is preferably made 1.00% or less. From the viewpoint of the Young's modulus, it is more preferable to make the amount of Si 0.60% or less, more preferably 0.30% or less.

Mn is an important element in the present invention. Mn is an element lowering the temperature at which the γ-phase transforms to the ferrite phase, that is, the $Ar_3$ transformation point, when heated to a high temperature at the time of hot rolling. By the addition of Mn, the γ-phase becomes stable up to a low temperature and the temperature of the final rolling can be lowered. To obtain this effect, it is necessary to add Mn in an amount of 0.10% or more. Further, Mn, as explained later, is correlated with the stacking fault energy of the γ-phase. It affects the formation of the working texture at the γ-phase and the variant selection at the time of transformation, causes formation of the crystal orientation raising the rolling direction Young's modulus after transformation, and conversely suppresses the formation of orientation lowering the Young's modulus. From this viewpoint, it is preferable to add Mn in an amount of 1.00% or more. More preferably, 1.20% or more of Mn is added. Addition of 1.50% or more is most preferable. On the other hand, if the amount of addition of the Mn exceeds 3.00%, the rolling direction static Young's modulus falls. In addition, the strength becomes higher and the ductility falls, so the upper limit of the amount of Mn was made 3.00%. Further, if the amount of Mn exceeds 2.00%, the adhesion of the zinc plating is sometimes impaired. From the viewpoint of the rolling direction Young's modulus as well, the amount is preferably made 2.00% or less.

P is an impurity, but it may be deliberately added when the strength has to be increased. Further, P has the effect of making the hot rolled structure finer and improving the workability. However, if the amount of addition exceeds 0.150%, the fatigue strength after spot welding deteriorates and the yield strength increases and defects in the surface properties are caused at the time of press working. Furthermore, the alloying reaction becomes extremely slow at the time of continuous hot dip galvanization and the productivity falls. Further, the secondary workability also deteriorates. Therefore, the upper limit was made 0.15.

S is an impurity. If over 0.0150%, it becomes a cause of hot cracking and causes deterioration of the workability, so this is made the upper limit.

Al is a deoxidizing adjuster. No lower limit is particularly limited, but from the viewpoint of deoxidation, it is preferably 0.010% or more. On the other hand, Al remarkably raises the transformation point, so if adding more than 0.150%, low temperature γ-region rolling becomes difficult, so the upper limit was made 0.150%.

To raise the static Young's moduli of both the sheet thickness surface layer and center part, it is preferable to satisfy the following formula 2:

$$4 \leqq 3.2Mn+9.6Mo+4.7W+6.2Ni+18.6Cu+0.7Cr \leqq 10 \qquad \text{formula 2}$$

Here, Mn, Mo, W, Ni, Cu, and Cr are the contents (mass %) of the elements. Note that when the amounts of addition of Mo, W, Ni, Cu, and Cr are less than the preferred lower limit values, the relationship of the formula 2 is calculated deeming these as "0".

If satisfying the above formula 2, orientation raising the rolling direction Young's modulus concentrates at the shear layer of the surface layer of the steel sheet or near the center part of the sheet thickness and concentration lowering the rolling direction Young's modulus is suppressed. Note that if the above formula 2 exceeds 10, the {332}<113> orientation lowering the rolling direction Young's modulus easily forms and the formation of the {225}<110> orientation or {001}<110> orientation and {112}<110> orientation raising the rolling direction Young's modulus tends to be suppressed.

Further, if adding Mn and, if necessary, one or two of Mo, W, Ni, Cu, and Cr so that the value of the formula 2 becomes preferably 4.5 or more, more preferably 5.5 or more, the rolling direction Young's modulus can be raised. However, if not satisfying formula 2 and the value of the relationship exceeds 10, the mechanical properties deteriorate, the texture of the sheet thickness center part deteriorates, and the rolling direction static Young's modulus sometimes falls, so the value of the relationship is preferably made 10 or less. From this viewpoint, 8 or less is more preferable.

Mo, Cr, W, Cu, and Ni are elements which affect the stacking fault energy of the y-phase at the time of hot rolling. It is preferable to add one or more types at 0.01% or more. Note that if compositely adding one or more types of Mo, Cr, W, Cu, and Ni and Mn, this has an effect on the formation of the working texture, forms the crystal orientations raising the rolling direction Young's modulus at the surface layer to the ⅙ sheet thickness part, that is, {110}<111> and {211}<111>, and suppresses the formation of the orientations lowering the Young's modulus, that is, {100}<001> and {110}<001>.

Further, one or more types of Mo, Cr, W, Cu, and Ni are preferably added together with Mn so as to satisfy the above (2). This is because, at the sheet thickness center part, it is possible to suppress the concentration of the {332}<113> orientation lowering the rolling direction Young's modulus and raise the concentration of the {225}<110> orientation and {001}<110> orientation and {112}<110> orientation raising the rolling direction Young's modulus. In particular, Mo and Cu have high coefficients of the above formula 2. Even if added in small amounts, they exhibit the effect of raising the Young's modulus, so addition of one or both of Mo and Cu is more preferable. Further, Cr is an element raising the hardenability to contribute to the improvement of the strength and is effective for improvement of the corrosion resistance as well. Addition of 0.02% is preferred.

On the other hand, due to the addition of Mo, the strength rises and the workability is sometimes impaired, so the upper limit of the amount of addition of Mo is preferably made 1.00%. Further, from the viewpoint of the cost, 0.50% or less of Mo is preferably added. Further, the upper limit of the one or more types of Cr, W, Cu, and Ni is, from the viewpoint of the workability, 3.00%. Note that the more preferable upper limits of the W, Cu, and Ni are respectively, by mass %, 1.40%, 0.35%, and 1.00%.

B is an element which remarkably suppresses recrystallization by composite addition with Nb and improves the hardenability in the solid solute state. It is believed to have an effect on the variant selectivity of the crystal orientation at the time of transformation from austenite to ferrite. Therefore, it is believed to promote the formation of the orientations raising the Young's modulus, that is, the {110}<111> to {110}<112> orientation group, and simultaneously suppress the formation of the orientations lowering the Young's modulus, that is, the {100}<001> orientation and the {110}<001> orientation. From this viewpoint, addition of 0.0005% or more is preferable. On the other hand, even if B is added in an amount over 0.0100%, no further effect can be obtained, so the upper limit was made 0.0100%. Further, if adding B in an amount over 0.005%, the workability sometimes deteriorates, so 0.0050% or less is preferable. 0.0030% or less is more preferable.

Ca, Rem, and V have the effect of raising the mechanical strength or improving the material quality. One or more types are preferably included in accordance with need.

If the amounts of Ca and Rem are less than 0.0005% and the amount of addition of V is less than 0.001%, sometimes a sufficient effect cannot be obtained. On the other hand, if the amounts of addition of Ca and Rem exceed 0.1000% and the amount of addition of V exceeds 0.100%, the ductility is sometimes impaired. Therefore, Ca, Rem, and V are respectively preferably added in the ranges of 0.0005 to 0.1000%, 0.0005 to 0.1000%, and 0.001 to 0.100%.

Next, the reasons for limitation of the production conditions will be explained.

Steel is produced and cast by ordinary methods to obtain the steel slab for use for hot rolling. This steel slab may also be obtained by forging or rolling a steel ingot, but from the viewpoint of the productivity, it is preferable to use continuous casting to produce a steel slab. Further, it may be produced by a thin slab caster.

Further, usually, a steel slab is cast, then cooled and again heated for hot rolling. In this case, the heating temperature of the steel slab at the time of hot rolling is preferably 1100° C. or more. This is because if the heating temperature of the steel slab is less than 1100° C., it becomes hard to make the finishing temperature of the hot rolling the $Ar_3$ transformation point or more. To efficiently and uniformly heat the steel slab, the heating temperature is preferably made 1150° C. or more. No upper limit is defined for the heating temperature, but if heating to over 1300° C., the crystal grain size of the steel sheet becomes rough and the workability is sometimes impaired. Further, a process such as continuous casting-direct rolling (CC-DR) which casts the molten steel, then directly hot rolls it may also be employed.

In the production of the steel sheet of the present invention, the conditions at the hot rolling at 1100° C. or less are important. The shape ratio is defined as explained above. Note that the diameters of the rolling rolls are measured at room temperature. There is no need to consider the flatness during hot rolling. The entry side and exit side sheet thicknesses of the rolling rolls may be measured on the spot using radiant rays etc. or may be found by calculation from the rolling load considering deformation resistance etc. Further, the hot rolling at a temperature over 1100° C. is not particularly defined and may be suitably performed. That is, the rough rolling of the steel slab is not particularly limited and may be performed by an ordinary method.

In the hot rolling, the rolling rate at 1100° C. or less up to the final pass is made 40% or more. This is because even if hot rolling over 1100° C., the structure after working recrystallizes and the effect of raising the X-ray random intensity ratios of the {110}<111> to {110}<112> orientation group at the ⅙ sheet thickness part cannot be obtained.

The rolling rate at 1100° C. or less up to the final pass is the difference of the sheet thickness of the steel sheet at 1100° C. and the sheet thickness of the steel sheet after the final pass divided by the sheet thickness of the steel sheet at 1100° C. expressed as a percentage.

This is because if this rolling rate is less than 40%, at the ⅙ sheet thickness part, the texture raising the rolling direction Young's modulus does not sufficiently form. Further, making this rolling rate 40% or more is preferable for raising the texture raising the rolling direction Young's modulus at the ½ sheet thickness part. To raise the rolling direction Young's modulus at the ⅙ sheet thickness part and ½ sheet thickness part, this rolling rate is preferably made 50% or more. In particular, to raise the rolling direction Young's modulus at the ½ sheet thickness part, it is preferable to raise the rolling rate at a lower temperature.

Note that when the value of the above formula 2 is slightly high, if increasing the rolling rate, at the ½ sheet thickness part, the formation of the {225}<110> orientation or {001}<110> orientation and {112}<110> orientation raising the rolling direction Young's modulus is promoted, but the {332}<113> orientation lowering the rolling direction Young's modulus also tends to form more easily.

No upper limit is particularly provided for the rolling rate, but if a rolling rate at 1100° C. or less up to the final pass of over 95%, not only is the load on the rolling mill raised, but also the Young's modulus causing the texture as well to change starts to fall, so the rate is preferably made 95% or less. From this viewpoint, 90% or less is more preferable.

The temperature of the final pass in the hot rolling is made the $Ar_3$ transformation point or more. This is because if rolling at less than the $Ar_3$ transformation point, at the ⅙ sheet thickness part, the {110}<001> texture not preferable for the rolling direction and transverse direction Young's moduli forms. Further, if the temperature of the final pass of the hot rolling is over 900° C., it is difficult to make the texture preferable for raising the rolling direction Young's modulus form and the X-ray random intensity ratios of the {110}<111> to {110}<112> orientation group at the ⅙ sheet thickness part fall. To raise the rolling direction Young's modulus, it is preferable to lower the rolling temperature of the final pass. Conditional on being the $Ar_3$ transformation point or more, the temperature is preferably 850° C. or less, more preferably 800° C. or less.

Note that the $Ar_3$ transformation temperature may be calculated by the following formula 4:

$$Ar_3=901-325\times C+33\times Si+287\times P+40\times Al-92\times(Mn+Mo+Cu)-46\times(Cr+Ni) \quad \text{formula 4}$$

where, C, Si, P, Al, Mn, Mo, Cu, Cr, and Ni are the contents of the elements (mass %), a content of an extent of an impurity being indicated as "0".

After the end of the hot rolling, the steel strip has to be coiled up at 700° C. or less. This is because if coiling it up at 700° C. or more, the sheet may recrystallize in the subsequent cooling, the texture may be destroyed, and the Young's modulus may fall. From this viewpoint, the temperature is preferably made 650° C. or less. More preferably, it is made 600° C. or less. The lower limit of the coiling temperature is not particularly limited, but if coiling up the strip at room temperature or less, there is no particular effect. It merely raises the load of the facility, so room temperature is made the lower limit.

To effectively introduce shear strain from the surface layer of the steel sheet down to at least the ⅙ sheet thickness part, it is more preferable to make the effective strain $\epsilon^*$ calculated by the following formula 5 become 0.4 or more:

$$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n \quad \text{formula 5}$$

where, n is the number of rolling stands of the final hot rolling, $\epsilon_j$ is a strain given to the j-th stand, $\epsilon_n$ is a strain given at an n-th stand, ti is a travel time (s) between an i-th to i+1st stands, and Ti is calculated by the following formula 6 by a gas constant R (=1.987) and a rolling temperature Ti (K) of an i-th stand:

$$\tau_i = 8.46\times 10^{-9}\exp\left(\frac{43800}{R\times Ti}\right) \quad \text{formula 6}$$

The effective strain $\epsilon^*$ is an indicator of the cumulative strain considering recovery of dislocations at the time of hot rolling. By making this 0.4 or more, it is possible to more effectively secure strain introduced into the shear layer. The higher the effective strain $\epsilon^*$, the greater the thickness of the shear layer and the greater the formation of the texture preferable for improvement of the Young's modulus, so 0.5 or more is preferable and 0.6 or more is more preferable.

When making the effective strain $\epsilon^*$ 0.4 or more, to effectively introduce strain to the shear layer, it is preferable to make the coefficient of friction between the rolling rolls and the steel strip over 0.2. The coefficient of friction can be adjusted by controlling the rolling load, rolling speed, and type and amount of lubricant.

When performing the hot rolling, it is preferable to perform differential peripheral speed rolling with a differential peripheral speed rate of the rolling rolls of 1% or more for one pass or more. If performing the differential peripheral speed rolling with a difference in peripheral speeds of the top and bottom rolling rolls, shear strain is introduced near the surface layer and the formation of texture is promoted, so the Young's modulus is improved compared with no differential peripheral speed rolling. Here, the differential peripheral speed rate in the present invention shows the difference of peripheral speeds of the top and bottom rolling rolls divided by the peripheral speed of the low peripheral speed roll expressed as a percentage. Further, the differential peripheral speed rolling of the present invention is not particularly different in effect of improvement of the Young's modulus no matter which of the peripheral speeds of the top and bottom rolls is larger.

The differential peripheral speed rate of the differential peripheral speed rolling is preferably as large as possible to improve the Young's modulus. Therefore, the differential peripheral speed rate is preferably 1% to 5%. Furthermore, the differential peripheral speed rolling is preferably performed by a differential peripheral speed rate of 10% or more, but making the differential peripheral speed rate 50% or more is currently difficult.

Further, no upper limit is particularly defined for the number of differential peripheral speed rolling passes, but from the viewpoint of accumulation of shear strain introduced, a greater number gives a larger effect of improvement of the Young's modulus, so all of the passes of the rolling at 1100° C. or less may also be made differential peripheral speed rolling. Usually, the number of final hot rolling passes is up to about eight passes.

The hot rolled steel strip produced by this method may in accordance with need be pickled, then temper rolled in line or off line by a rolling rate of 10% or less. Further, in accordance with the application, it may be hot dip galvanized or hot dip galvannealed. The composition of the zinc plating is not particularly limited, but in addition to zinc, Fe, Al, Mn, Cr, Mg, Pb, Sn, Ni, etc. may be added in accordance with need. Note that the temper rolling may be performed after the galvanization and alloying treatment as well.

The alloying treatment was performed at 450 to 600° C. in range. If less than 450° C., the alloying does not proceed sufficiently, while if more than 600° C., excessive alloying proceeds and the plating layer becomes brittle, so the problem of peeling of the plating due to the press working etc. is induced. The time of the alloying treatment is made 10 seconds or more. If less than 10 seconds, the alloying does not proceed sufficiently. The upper limit of the alloying treatment is not particularly defined, but usually if the treatment is performed over 3000 seconds by a heat treatment facility set in the continuous line, the productivity will be impaired or capital investment will be required, so the production costs will rise.

Further, before the alloying treatment, in accordance with the configuration of the production facilities, the steel may be annealed at below the $Ac_3$ transformation temperature. If a temperature below this temperature, the texture is not changed much at all, so it is possible to suppress the drop in the Young's modulus.

EXAMPLES

Example 1

Steels having the compositions shown in Table 1 (balances of Fe and unavoidable impurities) were produced and cast into steel slabs. The steel slabs were heated, roughly rolled hot, then final rolled under the conditions shown in Table 2 and Table 3 (continuation of Table 2). The final rolling stand was comprised of a total of six passes. The roll diameter was 650 to 830 mm. Further, the final strip thickness after the final pass was made 1.6 mm to 10 mm. Furthermore, in Table 2 and Table 3, SRT (° C.) is the heating temperature of the steel slab, FT (° C.) is the temperature after the final pass of the rolling, that is, the final exit side, and CT (° C.) is the coiling temperature. The rolling rate is the difference of the strip thickness at 1100° C. and the final strip thickness divided by the sheet thickness at 1100° C. and is shown as a percentage. The column of the "shape ratio" shows the values of the shape ratios at the different passes. The "–" shown in the column of the "shape ratio" means that the rolling temperature in the pass has exceeded 1100° C. Further, the column "pass/fail" of the "shape ratio" shows "pass" when at least two of the shapes ratios of the passes are over 2.3 and "fail" when not.

Note that, the blank fields of Table 1 mean the elements are not deliberately added (same in Table 10). Further, "formula 1" of Table 1 is the value of the left side of the following formula 1 calculated by the contents of Ti and N (mass %):

$$Ti-48/14\times N\geqq 0.0005 \qquad \text{formula 1}$$

Steels W and Y of Table 1 are comparative examples without Ti added. "1" is shown in the column of "formula 1".

Further, "formula 2" of Table 1 is the value of the left side of the following formula 2 calculated based on the contents of Mn, Mo, W, Ni, Cu, and Cr (mass %):

$$3.2Mn+9.6Mo+4.7W+6.2Ni+18.6Cu+0.7Cr\geqq 4 \qquad \text{formula 2}$$

When the contents of Mn, Mo, W, Ni, Cu, and Cr are of the extents of impurities, for example, when the fields of Mo, W, Ni, Cu, and Cr of Table 1 are blank, the left side of formula 2 is calculated with them as "0".

Further, $Ar_3$ of Tables 1 to 3 is the $Ar_3$ transformation temperature calculated by the following formula 4:

$$Ar_3=901-325\times C+33\times Si+287\times P+40\times Al-92\times(Mn+Mo+Cu)-46\times(Cr+Ni) \qquad \text{formula 4}$$

Here, C, Si, P, Al, Mn, Mo, Cu, Cr, and Ni are the contents of the elements (mass %), a content of an extent of an impurity being indicated as "0".

A tensile test piece based on JIS Z 2201 was obtained from the obtained steel sheet and a tensile test was performed based on JIS Z 2241 to measure the tensile strength. The Young's modulus was measured by both the static tension method and the vibration method.

The Young's modulus was measured by the static tension method by using a tensile test piece based on JIS Z 2201 and giving a tensile stress equivalent to ½ of the yield strength of the steel sheet. The measurement was conducted five times, the average value of the three measurement values minus the largest value and smallest value among the Young's moduli calculated based on the slant of the stress-strain graph was found as the Young's modulus by the static tension method, and this was used as the static Young's modulus.

The vibration method was performed by the horizontal resonance method at ordinary temperature based on JIS Z 2280. That is, a sample was given vibration without fixing it in place, the vibration number of the oscillator was gradually changed to measure the primary resonance vibration number, the vibration number was used to find the Young's modulus by calculation, and this was used as the dynamic Young's modulus.

Further, the X-ray random intensity ratios of the {100}<001> and {110}<001> orientation and {110}<111> to {110}<112> orientation group and the {211}<111> orientation of the ⅙ sheet thickness part of the steel sheet were measured as follows. First, the steel sheet was mechanically polished and buffed, then was electrolytically polished to remove the strain and adjusted so that the ⅙ sheet thickness part became the measurement surface. The sample was used for X-ray diffraction. Note that, X-ray diffraction of a standard sample without concentration in a specific orientation was performed under the same conditions. Next, based on a {110}, {100}, {211}, {310} pole figure obtained by X-ray diffraction, an ODF was obtained by the series expansion method. From this ODF, the X-ray random intensity ratios of the {100}<001> and {110}<001> orientation and the {110}<111> to {110}<112> orientation group were found.

The {332}113> orientation and {225}<110> orientation of the ½ sheet thickness part of the steel sheet, in the same way as the sample of the ⅙ sheet thickness part, were found from the ODF by X-ray diffraction using samples adjusted so that the ½ sheet thickness part became the measurement surface.

Further, among these steel sheets, those hot dip galvanized after the end of hot rolling were indicated as "hot dip" and those hot dip galvannealed at 520° C. for 15 seconds were indicated as "alloy".

The results are shown in Table 4 and Table 5 (continuation of Table 4). Note that the "RD" in the column of the Young's modulus means the rolling direction and "TD" means the direction perpendicular to the rolling direction, that is, the transverse direction.

As clear from Table 4 and Table 5, when hot rolling steel having the chemical ingredients of the present invention under suitable conditions, the Young's modulus by the static tension method in both the rolling direction and rolling perpendicular orientation could exceed 220 GPa. In particular, it is learned that when simultaneously satisfying the conditions of texture of the sheet thickness center layer, the Young's modulus by the static tension method is high and difference from the vibration method becomes smaller.

Note that, Steel N has a value of formula 2 outside the preferred range. This is an example where the texture of the ½ sheet thickness part is somewhat degraded, the difference between the static Young's modulus and dynamic Young's modulus becomes larger, and the rolling direction static Young's modulus falls somewhat.

On the other hand, Production Nos. 43 to 48 are comparative examples of Steels U to Z with chemical ingredients outside the range of the present invention.

Production No. 43 is an example of use of Steel U excessively containing Nb. The sum of the X-ray random intensity ratios of the {100}<001> orientation and the {110}<001> orientation of the ⅙ sheet thickness part becomes larger, the sum of the maximum value of the X-ray random intensity ratios of the {110}<111> to {110}<112> orientation group and the X-ray random intensity ratio of the {211}<111> orientation falls, and, further, the ratio of the X-ray random intensity ratio of the {332}<113> orientation (A) and the X-ray random intensity ratio of the {225}<110> orientation (B), (A)/(B), of the ½ sheet thickness part becomes somewhat lower, and rolling direction Young's modulus falls. The reason why the sum of the X-ray random intensity ratios of the {100}<001> and {110}<001> orientations becomes strong is unclear, but it is believed that the excessive addition of Nb caused the formation of a sheared texture at the γ-phase and a change in the variant selectivity at the time of subsequent transformation from the γ-phase to the ferrite phase. The transverse direction Young's modulus, as known from the past, is obtained as a high value due to the rolled transformed texture from the unrecrystallized γ developed from the sheet thickness center layer. In the present invention as well, a high Young's modulus in the transverse direction is achieved by a similar mechanism.

Production No. 44 is an example of Steel V with a small amount of Mn. The Young's modulus of the rolling direction falls. This is because along with the drop in Mn, the $Ar_3$ transformation temperature rises and, as a result, the hot rolling is performed under the $Ar_3$ transformation temperature and the concentration of the {110}<001> orientation rises.

Production No. 45 is an example of Steel W not containing Ti and not satisfying formula 1. Further, the calculated value of formula 2 is also less than a preferable lower limit value, the sum of the X-ray random intensity ratios of the {110}<111> to {110}<112> orientation group and the X-ray random intensity ratio of the {211}<111> orientation of the ⅙ sheet thickness part falls, and the rolling direction Young's modulus falls.

Production Nos. 46 to 48 are examples using Steel X not satisfying formula 1, Steel Y not containing Ti and not satisfying formula 1, and Steel Z not containing Nb. The sum of the X-ray random intensity ratios of the {110}<111> to {110}<112> orientation group and the X-ray random intensity ratio of the {211}<111> orientation falls and the rolling direction Young's modulus falls. In only the Steel Z, the transverse direction Young's modulus also simultaneously falls, but this is because almost no element for suppressing recrystallization is added to the Steel Z, so it is guessed that the formation of the rolled transformed texture at the sheet thickness center part was insufficient.

Further, as shown by the comparative examples of the Steels C and J, that is, Production Nos. 8 and 24, if there are few passes where the shape ratio is 2.3 or more, even if a high Young's modulus is obtained with the vibration method, over 220 GPa cannot be obtained by the static tension method.

The comparative example of Steel B, that is, Production No. 5, and the comparative example of Steel G, that is, Production No. 18, have high finishing temperatures FT (° C.) of hot rolling, have a falling sum of the X-ray random intensity ratios of the {110}<111> to {110}<112> orientation group and {211}<111> orientation preferable for improvement of the rolling direction Young's modulus at the ⅙ sheet thickness part, and do not form texture at all of the sheet thickness directions, so the transverse direction Young's modulus also falls.

The comparative example of Steel K, that is, Production No. 27, is an example where the coiling temperature CT (° C.) is high and the sum of the X-ray random intensity ratios of the {110}<111> to {110}<112> orientation group and the {211}<111> orientation preferable for improvement of the rolling direction Young's modulus at the ⅙ sheet thickness part falls.

The comparative example of Steel E, that is, Production No. 13, has a lowered heating temperature SRT (° C.) of the steel slab, is an example where the finishing temperature FT (° C.) of the hot rolling falls below the Ar3 transformation temperature and, for this reason, at the ⅙ sheet thickness part, the X-ray random intensity ratio of the {100}<001> orientation becomes higher and the rolling direction and transverse direction Young's moduli fall.

The comparative example of Steel H, that is, Production No. 20, is an example where the rolling rate of the final rolling, that is, the rolling rate at 1100° C. or less, is low, so the sum of the X-ray random intensity ratios of the {110}<111> to {110}<112> orientation group and {211}<111> orientation falls and the rolling direction and transverse direction Young's moduli fall.

The comparative example of Steel N, that is, Production No. 35, is an example where the rolling rate at 1100° C. or less of the hot rolling is low and the number of passes where the shape ratio is 2.3 or more is small, so the X-ray random intensity ratios of the {110}<111> to {110}<112> orientation group fall and the rolling direction and transverse direction Young's moduli fall.

TABLE 1

| | Ingredients (mass %) | | | | | | | | | |
|---|---|---|---|---|---|---|---|---|---|---|
| Steel | C | Si | Mn | P | S | Al | N | Nb | Ti | B |
| A | 0.007 | 0.01 | 1.30 | 0.012 | 0.0040 | 0.030 | 0.0018 | 0.025 | 0.020 | 0.0008 |
| B | 0.020 | 0.01 | 2.10 | 0.008 | 0.0060 | 0.050 | 0.0021 | 0.040 | 0.025 | 0.0013 |
| C | 0.050 | 0.60 | 1.60 | 0.008 | 0.0050 | 0.060 | 0.0019 | 0.035 | 0.030 | 0.0017 |
| D | 0.050 | 0.01 | 1.20 | 0.009 | 0.0050 | 0.035 | 0.0030 | 0.012 | 0.020 | 0.0015 |
| E | 0.060 | 1.50 | 0.50 | 0.006 | 0.0060 | 0.040 | 0.0025 | 0.015 | 0.018 | |
| F | 0.080 | 0.01 | 1.60 | 0.010 | 0.0050 | 0.045 | 0.0021 | 0.030 | 0.020 | 0.0018 |
| G | 0.050 | 0.90 | 1.50 | 0.008 | 0.0060 | 0.032 | 0.0023 | 0.036 | 0.030 | 0.0021 |
| H | 0.035 | 0.01 | 1.60 | 0.012 | 0.0010 | 0.035 | 0.0018 | 0.042 | 0.034 | 0.0023 |
| I | 0.070 | 0.30 | 1.80 | 0.011 | 0.0040 | 0.041 | 0.0017 | 0.020 | 0.029 | 0.0009 |
| J | 0.040 | 0.01 | 1.70 | 0.009 | 0.0040 | 0.036 | 0.0020 | 0.030 | 0.018 | 0.0024 |
| K | 0.060 | 0.50 | 1.30 | 0.008 | 0.0060 | 0.033 | 0.0023 | 0.019 | 0.023 | 0.0032 |
| L | 0.080 | 0.80 | 1.60 | 0.006 | 0.0090 | 0.045 | 0.0024 | 0.021 | 0.045 | 0.0019 |
| M | 0.050 | 0.01 | 0.90 | 0.013 | 0.0030 | 0.042 | 0.0022 | 0.036 | 0.018 | 0.0036 |
| N | 0.030 | 0.30 | 1.80 | 0.040 | 0.0050 | 0.039 | 0.0026 | 0.038 | 0.025 | 0.0025 |
| O | 0.050 | 1.20 | 1.65 | 0.021 | 0.0070 | 0.040 | 0.0040 | 0.042 | 0.036 | 0.0018 |
| P | 0.120 | 0.60 | 1.80 | 0.010 | 0.0040 | 0.034 | 0.0036 | 0.028 | 0.035 | 0.0009 |
| Q | 0.150 | 1.20 | 1.40 | 0.013 | 0.0030 | 0.060 | 0.0028 | 0.035 | 0.040 | 0.0012 |
| R | 0.040 | 1.60 | 2.10 | 0.015 | 0.0040 | 0.035 | 0.0019 | 0.029 | 0.027 | 0.0016 |
| S | 0.100 | 0.01 | 1.40 | 0.012 | 0.0040 | 0.036 | 0.0026 | 0.031 | 0.038 | |
| T | 0.040 | 0.01 | 1.60 | 0.009 | 0.0003 | 0.022 | 0.0026 | 0.015 | 0.080 | |
| U | 0.028 | 0.01 | 1.50 | 0.009 | 0.0060 | 0.045 | 0.0020 | 0.180 | 0.031 | 0.0015 |
| V | 0.040 | 1.60 | 0.08 | 0.012 | 0.0050 | 0.040 | 0.0020 | 0.030 | 0.015 | 0.0020 |
| W | 0.060 | 0.01 | 1.00 | 0.030 | 0.0050 | 0.032 | 0.0023 | 0.035 | | |
| X | 0.050 | 0.05 | 2.30 | 0.008 | 0.0070 | 0.035 | 0.0035 | 0.035 | 0.008 | 0.0036 |
| Y | 0.060 | 0.30 | 1.30 | 0.006 | 0.0020 | 0.036 | 0.0039 | | | 0.0029 |
| Z | 0.080 | 0.60 | 1.50 | 0.009 | 0.0030 | 0.029 | 0.0025 | | 0.025 | |

| | Ingredients (mass %) | | | | | Ar3 | |
|---|---|---|---|---|---|---|---|
| Steel | Cr, W, Cu, Ni | Mo | Ca, V, Rem | Form. 1 | Form. 2 | ° C. | Remarks |
| A | Cr: 0.02, Cu: 0.03 | | | 0.014 | 4.73 | 780 | Inv. ex. |
| B | | | | 0.018 | 6.72 | 706 | |
| C | Cr: 0.03 | 0.15 | | 0.023 | 6.54 | 747 | |
| D | Cr: 0.04, Cu: 0.05 | | | 0.010 | 4.80 | 772 | |
| E | Cr: 0.04, Cu: 0.15, Ni: 0.08 | | | 0.009 | 4.91 | 869 | |
| F | Cr: 0.03, Cu: 0.02 | | | 0.013 | 5.51 | 730 | |
| G | | 0.10 | | 0.022 | 5.73 | 771 | |
| H | | | Ca: 0.0005 | 0.028 | 5.12 | 748 | |
| I | W: 0.30 | | | 0.023 | 7.17 | 727 | |
| J | | 0.20 | | 0.011 | 7.30 | 718 | |
| K | Cr: 0.02, Cu: 0.04 | | | 0.015 | 4.92 | 777 | |
| L | Cr: 0.50, Cu: 0.06 | | | 0.037 | 6.59 | 729 | |
| M | Cu: 0.28, Ni: 0.14 | | | 0.010 | 8.96 | 775 | |
| N | Cu: 0.20, Ni: 0.10 | 0.20 | Rem: 0.002 | 0.016 | 11.96 | 707 | |
| O | Cu: 0.13, Ni: 0.07 | | | 0.022 | 8.13 | 765 | |
| P | | | V: 0.020 | 0.023 | 5.76 | 720 | |
| Q | Cr: 0.50, W: 0.18 | 0.08 | | 0.030 | 6.42 | 739 | |
| R | | 0.35 | | 0.020 | 9.98 | 721 | |
| S | Cu: 0.20, Ni: 0.10 | | | 0.029 | 8.20 | 727 | |
| T | | | | 0.071 | 5.12 | 745 | |
| U | | | | 0.024 | 4.80 | 759 | Comp. |
| V | Cr: 0.02, Cu: 0.01, Ni: 0.03 | | | 0.008 | 0.64 | 935 | ex. |
| W | | | | — | 3.20 | 800 | |
| X | W: 0.20 | | | −0.004 | 8.30 | 678 | |
| Y | Cr: 0.50, Cu: 0.06, Ni: 0.02 | | | — | 5.75 | 746 | |
| Z | Cr: 0.02, Cu: 0.03 | | V: 0.005 | 0.016 | 5.37 | 757 | |

(Note)

Underlines are conditions outside range of present invention.

Formula 1: Ti − 48/14 × N,

Formula 2: 3.2Mn + 9.6Mo + 4.7W + 6.2Ni + 18.6Cu + 0.7Cr

TABLE 2

| Prod. | | Ar3 | SRT | Rolling | Shape ratio | | | | | | | FT | CT | | |
|---|---|---|---|---|---|---|---|---|---|---|---|---|---|---|---|
| No. | Steel | ° C. | ° C. | rate % | 1P | 2P | 3P | 4P | 5P | 6P | Pass/fail | ° C. | ° C. | Plating | Remarks |
| 1 | A | 780 | 1250 | 65 | — | 3.92 | 4.69 | 5.69 | 6.36 | 5.31 | Pass | 885 | 500 | Hot dip | Inv. ex. |
| 2 | | | 1150 | 79 | 2.56 | 3.47 | 5.00 | 5.59 | 5.73 | 4.85 | Pass | 850 | 550 | | Inv. ex. |
| 3 | | | 1200 | 55 | 2.64 | 3.50 | 5.29 | 5.83 | 6.20 | 4.94 | Pass | 863 | 550 | | Inv. ex. |
| 4 | B | 706 | 1250 | 77 | — | 3.02 | 4.21 | 4.45 | 4.76 | 3.59 | Pass | 876 | 600 | | Inv. ex. |
| 5 | | | 1230 | 79 | 2.68 | 3.64 | 5.34 | 6.09 | 6.00 | 4.65 | Pass | 920 | 550 | | Comp. ex. |
| 6 | C | 747 | 1200 | 76 | 2.32 | 2.93 | 4.19 | 4.12 | 4.19 | 3.51 | Pass | 818 | 450 | | Inv. ex. |
| 7 | | | 1250 | 80 | — | 3.57 | 5.23 | 5.92 | 6.11 | 5.23 | Pass | 885 | 500 | | Inv. ex. |
| 8 | | | 1200 | 65 | 1.10 | 2.02 | 2.50 | 2.29 | 2.18 | 1.68 | Fail | 840 | 600 | | Comp. ex. |
| 9 | D | 772 | 1250 | 63 | — | 2.43 | 2.38 | 2.25 | 2.08 | 1.53 | Pass | 862 | 500 | | Inv. ex. |
| 10 | | | 1250 | 63 | — | 2.42 | 2.41 | 2.19 | 2.07 | 1.58 | Pass | 878 | 500 | | Inv. ex. |
| 11 | E | 869 | 1230 | 66 | 2.21 | 2.41 | 2.72 | 2.52 | 2.40 | 1.93 | Pass | 892 | 600 | | Inv. ex. |
| 12 | | | 1200 | 63 | 2.04 | 2.49 | 2.57 | 2.02 | 1.95 | 1.47 | Pass | 885 | 500 | | Inv. ex. |
| 13 | | | 1000 | 66 | 2.17 | 2.55 | 2.69 | 2.51 | 2.42 | 1.82 | Pass | 825 | 500 | | Comp. ex. |
| 14 | F | 730 | 1170 | 72 | 2.23 | 2.89 | 3.36 | 2.82 | 2.33 | 2.96 | Pass | 815 | 500 | | Inv. ex. |
| 15 | | | 1150 | 76 | 2.11 | 2.56 | 3.09 | 2.87 | 2.57 | 1.91 | Pass | 792 | 600 | Alloy | Inv. ex. |
| 16 | G | 771 | 1075 | 75 | 2.37 | 2.95 | 3.88 | 3.86 | 3.35 | 3.37 | Pass | 892 | 500 | | Inv. ex. |
| 17 | | | 1200 | 70 | 2.10 | 2.70 | 3.18 | 2.58 | 2.44 | 1.92 | Pass | 863 | 550 | | Inv. ex. |
| 18 | | | 1250 | 69 | — | — | — | 2.55 | 2.42 | 2.07 | Pass | 935 | 650 | | Comp. ex. |
| 19 | H | 688 | 1230 | 74 | 2.34 | 2.99 | 3.77 | 3.95 | 3.61 | 2.87 | Pass | 882 | 650 | | Inv. ex. |
| 20 | | | 1250 | 31 | — | — | 1.65 | 1.73 | 1.89 | 2.32 | Pass | 893 | 550 | | Comp. ex. |
| 21 | I | 727 | 1200 | 68 | 2.12 | 2.46 | 2.76 | 2.55 | 2.09 | 2.02 | Pass | 861 | 350 | | Inv. ex. |
| 22 | | | 1150 | 62 | 2.01 | 2.41 | 2.41 | 2.21 | 2.10 | 1.49 | Pass | 823 | 500 | | Inv. ex. |
| 23 | J | 718 | 1170 | 76 | 2.44 | 3.13 | 4.09 | 4.44 | 4.65 | 3.66 | Pass | 829 | 550 | | Inv. ex. |
| 24 | | | 1250 | 63 | — | — | — | 2.19 | 2.08 | 1.49 | Fail | 892 | 550 | | Comp. ex. |

(Note)
Underlines are conditions outside range of present invention.

TABLE 3

| Prod. | | Ar3 | SRT | Rolling | Shape ratio | | | | | | | FT | CT | | |
|---|---|---|---|---|---|---|---|---|---|---|---|---|---|---|---|
| No. | Steel | ° C. | ° C. | rate % | 1P | 2P | 3P | 4P | 5P | 6P | Pass/fail | ° C. | ° C. | Plating | Remarks |
| 25 | K | 777 | 1230 | 64 | 2.03 | 2.43 | 2.51 | 2.38 | 2.37 | 1.58 | Pass | 887 | 500 | | Inv. ex. |
| 26 | | | 1200 | 66 | 2.07 | 2.50 | 2.65 | 2.61 | 2.46 | 1.90 | Pass | 853 | 550 | Hot dip | Inv. ex. |
| 27 | | | 1250 | 70 | — | — | 2.30 | 2.10 | 2.20 | 2.54 | Pass | 898 | 750 | | Comp. ex. |
| 28 | L | 729 | 1170 | 65 | 2.11 | 2.60 | 2.53 | 2.37 | 2.33 | 1.64 | Pass | 821 | 500 | | Inv. ex. |
| 29 | | | 1150 | 76 | 2.49 | 3.17 | 4.45 | 4.53 | 4.62 | 3.83 | Pass | 795 | 550 | Alloy | Inv. ex. |
| 30 | | | 1270 | 77 | — | — | 4.16 | 4.74 | 4.85 | 3.66 | Pass | 885 | 350 | | Inv. ex. |
| 31 | M | 775 | 1230 | 79 | 2.81 | 3.70 | 4.61 | 5.57 | 6.40 | 5.85 | Pass | 873 | 500 | | Inv. ex. |
| 32 | | | 1200 | 50 | 1.95 | 2.44 | 2.30 | 2.08 | 1.87 | 1.35 | Pass | 861 | 600 | | Inv. ex. |
| 33 | N | 707 | 1200 | 73 | 2.38 | 2.94 | 3.60 | 3.76 | 3.91 | 3.19 | Pass | 864 | 550 | | Inv. ex. |
| 34 | | | 1250 | 76 | — | 3.07 | 4.03 | 4.40 | 4.79 | 3.66 | Pass | 897 | 650 | | Inv. ex. |
| 35 | | | 1150 | 25 | 1.92 | 2.30 | 2.20 | 1.98 | 1.89 | 1.50 | Fail | 805 | 500 | | Comp. ex. |
| 36 | O | 765 | 1200 | 74 | 2.29 | 2.90 | 3.88 | 3.93 | 3.88 | 2.80 | Pass | 862 | 550 | | Inv. ex. |
| 37 | P | 720 | 1130 | 65 | 2.02 | 2.53 | 2.40 | 2.20 | 2.14 | 1.67 | Pass | 826 | 500 | | Inv. ex. |
| 38 | | | 1230 | 77 | 2.57 | 3.31 | 4.45 | 4.48 | 4.80 | 3.68 | Pass | 895 | 500 | | Inv. ex. |
| 39 | Q | 739 | 1200 | 77 | 2.57 | 3.29 | 4.57 | 4.99 | 5.18 | 4.27 | Pass | 862 | 650 | | Inv. ex. |
| 40 | R | 721 | 1250 | 79 | 2.57 | 3.43 | 4.98 | 5.12 | 5.75 | 4.74 | Pass | 889 | 550 | | Inv. ex. |
| 41 | S | 727 | 1150 | 61 | 2.32 | 2.65 | 3.49 | 3.53 | 3.50 | 1.89 | Pass | 865 | 550 | | Inv. ex. |
| 42 | T | 745 | 1250 | 44 | 1.57 | 1.23 | 2.31 | 1.89 | 2.50 | 2.62 | Pass | 850 | 600 | | Inv. ex. |
| 43 | U | 759 | 1250 | 79 | 2.48 | 3.36 | 4.82 | 5.42 | 5.68 | 4.95 | Pass | 895 | 550 | | Comp. ex. |
| 44 | V | 935 | 1170 | 77 | 2.51 | 3.45 | 4.59 | 5.13 | 4.96 | 3.71 | Pass | 830 | 550 | | Comp. ex. |
| 45 | W | 800 | 1200 | 74 | 2.34 | 2.99 | 3.90 | 3.84 | 3.81 | 2.87 | Pass | 845 | 500 | | Comp. ex. |
| 46 | X | 678 | 1150 | 43 | 1.42 | 1.85 | 2.30 | 2.25 | 1.98 | 1.79 | Fail | 825 | 550 | | Comp. ex. |
| 47 | Y | 746 | 1250 | 77 | 2.33 | 3.06 | 4.23 | 4.39 | 4.45 | 3.72 | Pass | 850 | 650 | | Comp. ex. |
| 48 | Z | 757 | 1170 | 74 | 2.18 | 2.75 | 3.57 | 3.57 | 3.52 | 2.63 | Pass | 809 | 450 | | Comp. ex. |

(Note)
Underlines are conditions outside range of present invention.

TABLE 4

| Prod. No. | Steel | TS MPa | ⅙ sheet thickness part texture 1* | ⅙ sheet thickness part texture 2* | ½ sheet thickness part texture {332}<113> (A) | ½ sheet thickness part texture {225}<110> (B) | (A)/(B) | Static Young's modulus RD GPa | Static Young's modulus TD GPa | Dynamic Young's modulus RD GPa | Dynamic Young's modulus TD GPa | Remarks |
|---|---|---|---|---|---|---|---|---|---|---|---|---|
| 1 | A | 415 | 2.7 | 6.2 | 4.2 | 6.5 | 0.65 | 225 | 228 | 231 | 232 | Inv. ex. |
| 2 | | 425 | 0.0 | 9.3 | 4.5 | 6.9 | 0.65 | 228 | 235 | 230 | 235 | Inv. ex. |
| 3 | | 430 | 0.8 | 8.4 | 5.2 | 7.3 | 0.71 | 227 | 231 | 232 | 234 | Inv. ex. |
| 4 | B | 576 | 1.8 | 6.4 | 5.0 | 6.6 | 0.76 | 225 | 229 | 233 | 233 | Inv. ex. |
| 5 | | 623 | 2.5 | 3.0 | 4.9 | 5.8 | 0.84 | 206 | 216 | 216 | 223 | Comp. ex. |
| 6 | C | 782 | 0.3 | 11.1 | 8.2 | 10.2 | 0.80 | 231 | 235 | 235 | 233 | Inv. ex. |
| 7 | | 723 | 1.7 | 7.0 | 7.6 | 8.3 | 0.92 | 225 | 231 | 231 | 236 | Inv. ex. |
| 8 | | 689 | 0.8 | 4.6 | 4.5 | 6.2 | 0.73 | 214 | 223 | 232 | 230 | Comp. ex. |
| 9 | D | 545 | 1.9 | 8.4 | 4.6 | 8.3 | 0.55 | 226 | 228 | 231 | 231 | Inv. ex. |
| 10 | | 535 | 2.1 | 6.0 | 4.0 | 8.9 | 0.45 | 224 | 229 | 230 | 235 | Inv. ex. |
| 11 | E | 555 | 3.4 | 5.5 | 5.6 | 9.2 | 0.61 | 223 | 230 | 229 | 236 | Inv. ex. |
| 12 | | 592 | 3.5 | 6.5 | 4.2 | 8.8 | 0.48 | 223 | 228 | 230 | 234 | Inv. ex. |
| 13 | | 620 | 7.5 | 6.3 | 4.2 | 7.5 | 0.56 | 215 | 239 | 215 | 238 | Comp. ex. |
| 14 | F | 580 | 0.0 | 10.4 | 6.2 | 8.7 | 0.71 | 231 | 236 | 237 | 234 | Inv. ex. |
| 15 | | 544 | 0.0 | 12.6 | 7.2 | 9.3 | 0.77 | 233 | 234 | 240 | 236 | Inv. ex. |
| 16 | G | 758 | 3.2 | 5.7 | 6.2 | 7.9 | 0.78 | 223 | 226 | 231 | 234 | Inv. ex. |
| 17 | | 792 | 1.8 | 7.0 | 6.2 | 8.3 | 0.75 | 226 | 224 | 233 | 231 | Inv. ex. |
| 18 | | 725 | 0.0 | 1.2 | 5.2 | 5.2 | 1.00 | 206 | 215 | 216 | 223 | Comp. ex. |
| 19 | H | 601 | 0.2 | 7.4 | 4.3 | 8.6 | 0.50 | 226 | 231 | 231 | 231 | Inv. ex. |
| 20 | | 645 | 1.8 | 2.8 | 3.2 | 3.5 | 0.91 | 210 | 216 | 222 | 227 | Comp. ex. |
| 21 | I | 620 | 1.2 | 8.6 | 7.8 | 9.6 | 0.81 | 228 | 234 | 235 | 233 | Inv. ex. |
| 22 | | 582 | 0.0 | 11.2 | 7.3 | 9.4 | 0.78 | 230 | 231 | 239 | 233 | Inv. ex. |
| 23 | J | 589 | 0.0 | 11.1 | 4.6 | 11.2 | 0.41 | 230 | 233 | 234 | 236 | Inv. ex. |
| 24 | | 599 | 0.0 | 1.3 | 9.3 | 7.8 | 1.19 | 216 | 235 | 231 | 235 | Comp. ex. |

(Note)

Underlines are conditions outside range of present invention.

1*: Sum of X-ray random intensity ratio of {100}<001> orientation and X-ray random intensity ratio of {110}<001> orientation 2*: Sum of maximum value of X-ray random intensity ratios of {110}<111> to {110}<112> orientation group and X-ray random intensity ratio of {211}<111> orientation

TABLE 5

| Prod. No. | Steel | TS MPa | ⅙ sheet thickness part texture 1* | ⅙ sheet thickness part texture 2* | ½ sheet thickness part texture {332}<113> (A) | ½ sheet thickness part texture {225}<110> (B) | (A)/(B) | Static Young's modulus RD GPa | Static Young's modulus TD GPa | Dynamic Young's modulus RD GPa | Dynamic Young's modulus TD GPa | Remarks |
|---|---|---|---|---|---|---|---|---|---|---|---|---|
| 25 | K | 613 | 3.9 | 6.0 | 4.6 | 7.8 | 0.59 | 225 | 231 | 231 | 233 | Inv. ex. |
| 26 | | 629 | 1.1 | 8.5 | 5.3 | 8.2 | 0.65 | 226 | 236 | 235 | 232 | Inv. ex. |
| 27 | | 576 | 0.0 | 0.5 | 4.6 | 4.6 | 1.00 | 213 | 229 | 228 | 234 | Comp. ex. |
| 28 | L | 653 | 0.0 | 11.0 | 6.5 | 8.2 | 0.79 | 230 | 233 | 238 | 231 | Inv. ex. |
| 29 | | 659 | 0.0 | 11.5 | 5.9 | 7.7 | 0.77 | 234 | 236 | 238 | 234 | Inv. ex. |
| 30 | | 689 | 1.1 | 5.7 | 6.9 | 8.3 | 0.83 | 224 | 236 | 231 | 230 | Inv. ex. |
| 31 | M | 690 | 4.0 | 5.8 | 8.5 | 9.2 | 0.92 | 222 | 239 | 233 | 241 | Inv. ex. |
| 32 | | 699 | 2.1 | 6.3 | 10.5 | 11.5 | 0.91 | 223 | 234 | 235 | 236 | Inv. ex. |
| 33 | N | 735 | 1.1 | 8.4 | 16.0 | 5.8 | 2.76 | 225 | 231 | 242 | 233 | Inv. ex. |
| 34 | | 632 | 1.7 | 6.8 | 11.5 | 8.3 | 1.39 | 223 | 230 | 241 | 235 | Inv. ex. |
| 35 | | 752 | 0.0 | 0.0 | 2.6 | 3.2 | 0.81 | 204 | 216 | 204 | 220 | Comp. ex. |
| 36 | O | 650 | 1.3 | 9.0 | 7.6 | 8.2 | 0.93 | 227 | 231 | 232 | 231 | Inv. ex. |
| 37 | P | 662 | 0.9 | 14.4 | 7.9 | 10.6 | 0.75 | 234 | 231 | 239 | 234 | Inv. ex. |
| 38 | | 689 | 1.4 | 7.4 | 6.5 | 8.6 | 0.76 | 225 | 236 | 231 | 234 | Inv. ex. |
| 39 | Q | 660 | 1.4 | 9.0 | 8.2 | 9.6 | 0.85 | 227 | 235 | 232 | 236 | Inv. ex. |
| 40 | R | 980 | 1.2 | 7.4 | 9.5 | 10.5 | 0.90 | 223 | 234 | 237 | 237 | Inv. ex. |
| 41 | S | 594 | 4.3 | 5.9 | 6.9 | 8.3 | 0.83 | 222 | 235 | 229 | 237 | Inv. ex. |
| 42 | T | 792 | 2.3 | 6.0 | 4.6 | 12.5 | 0.37 | 223 | 235 | 230 | 235 | Inv. ex. |
| 43 | U | 708 | 5.7 | 4.8 | 6.1 | 5.5 | 1.11 | 213 | 231 | 231 | 235 | Comp. ex. |
| 44 | V | 442 | 4.3 | 2.6 | 1.2 | 8.3 | 0.14 | 209 | 230 | 221 | 232 | Comp. ex. |
| 45 | W | 523 | 9.2 | 6.1 | 7.6 | 10.3 | 0.74 | 216 | 231 | 237 | 232 | Comp. ex. |
| 46 | X | 728 | 3.9 | 3.8 | 5.3 | 7.8 | 0.68 | 215 | 228 | 220 | 233 | Comp. ex. |
| 47 | Y | 542 | 2.2 | 2.2 | 4.5 | 5.7 | 0.79 | 203 | 229 | 205 | 230 | Comp. ex. |
| 48 | Z | 555 | 4.3 | 2.7 | 3.6 | 6.2 | 0.58 | 206 | 216 | 205 | 217 | Comp. ex. |

(Note)

Underlines are conditions outside range of present invention.

1*: Sum of X-ray random intensity ratio of {100}<001> orientation and X-ray random intensity ratio of {110}<001> orientation 2*: Sum of maximum value of X-ray random intensity ratios of {110}<111> to {110}<112> orientation group and X-ray random intensity ratio of {211}<111> orientation Example 2

Steels C and M shown in Table 1 were used for hot rolling under the conditions shown in Table 6. Production Nos. 50, 52, and 53 shown in Table 6 are examples of differential peripheral speed rolling changing the differential peripheral speed rates at the final three passes of the final rolling stand comprised of a total of six passes, that is, the fourth pass, fifth pass, and sixth pass. Note that the hot rolling conditions not shown in Table 6 are all similar to Example 1. Further, in the same way as Example 1, the tensile properties and textures of the ⅙ sheet thickness part and ½ sheet thickness part were measured and the Young's modulus was measured. The results are shown in Table 7.

As clear from this, when hot rolling steel having the chemical ingredients of the present invention under suitable conditions, if applying 1% or more differential peripheral speed rolling for one pass or more, formation of texture near the surface layer is promoted and furthermore the Young's modulus is improved.

Example 3

Steels D and N shown in Table 1 were used for hot rolling while changing the effective strains ϵ* as shown in Table 8. Note that the hot rolling conditions not shown in Table 8 are all similar to Example 1. Further, in the same way as Example 1, the tensile properties and textures of the ⅙ sheet thickness part and ½ sheet thickness part were measured and the Young's modulus was measured. The results are shown in Table 9.

As clear from this, when hot rolling steel having the chemical ingredients of the present invention under suitable conditions, if making the effective strain ϵ* 0.4 or more, formation of texture near the surface layer is promoted and furthermore the Young's modulus is improved.

TABLE 6

| Prod. | | Ar3 | SRT | Rolling | Shape ratio | | | | | | | Differential peripheral speed rate (%) | | | FT | CT | |
|---|---|---|---|---|---|---|---|---|---|---|---|---|---|---|---|---|---|
| | | | | | | | | | | | | 4th | 5th | 6th | | | |
| No. | Steel | ° C. | ° C. | rate % | 1P | 2P | 3P | 4P | 5P | 6P | Pass/fail | pass | pass | pass | ° C. | ° C. | Remarks |
| 49 | C | 747 | 1250 | 80 | — | 3.57 | 5.23 | 5.92 | 6.11 | 5.23 | Pass | 0 | 0 | 0 | 885 | 500 | Inv. ex. |
| 50 | | | | 78 | 2.52 | 3.57 | 5.22 | 5.93 | 5.00 | 5.23 | Pass | 10 | 5 | 5 | 889 | 500 | Inv. ex. |
| 51 | M | 775 | 1200 | 52 | 1.95 | 2.44 | 2.30 | 2.20 | 1.87 | 2.40 | Pass | 0 | 0 | 0 | 861 | 600 | Inv. ex. |
| 52 | | | | 53 | 1.95 | 2.44 | 2.30 | 2.18 | 1.92 | 2.40 | Pass | 3 | 3 | 3 | 859 | 600 | Inv. ex. |
| 53 | | | | 55 | 1.95 | 2.44 | 2.30 | 2.25 | 1.93 | 2.35 | Pass | 0 | 20 | 20 | 855 | 600 | Inv. ex. |

TABLE 7

| Prod. | | TS | ⅙ sheet thickness part texture | | ½ sheet thickness part texture | | | Static Young's modulus | | Dynamic Young's modulus | | |
|---|---|---|---|---|---|---|---|---|---|---|---|---|
| | | | | | {332}<113> | {225}<110> | | RD | TD | RD | TD | |
| No. | Steel | MPa | 1* | 2* | (A) | (B) | (A)/(B) | GPa | GPa | GPa | GPa | Remarks |
| 49 | C | 723 | 1.7 | 8.0 | 7.6 | 8.3 | 0.92 | 225 | 231 | 231 | 236 | Inv. ex. |
| 50 | | 735 | 1.1 | 13.8 | 7.3 | 8.5 | 0.86 | 236 | 236 | 239 | 237 | Inv. ex. |
| 51 | M | 699 | 2.1 | 7.3 | 7.9 | 9.2 | 0.86 | 223 | 234 | 235 | 236 | Inv. ex. |
| 52 | | 712 | 1.6 | 9.2 | 6.5 | 7.2 | 0.9 | 232 | 237 | 238 | 239 | Inv. ex. |
| 53 | | 708 | 0.9 | 12.5 | 5.8 | 8.0 | 0.7 | 236 | 241 | 240 | 241 | Inv. ex. |

1*: Sum of X-ray random intensity ratio of {100}<001> orientation and X-ray random intensity ratio of {110}<001> orientation 2*: Sum of maximum value of X-ray random intensity ratios of {110}<111> to {110}<112> orientation group and X-ray random intensity ratio of {211}<111> orientation

TABLE 8

| Prod. No. | Steel | Ar3 ° C. | SRT ° C. | Rolling rate % | Shape ratio 1P | 2P | 3P | 4P | 5P | 6P | Pass/fail | FT ° C. | ϵ* | CT ° C. | Plating | Remarks |
|---|---|---|---|---|---|---|---|---|---|---|---|---|---|---|---|---|
| 54 | D | 772 | 1250 | 88 | 2.37 | 3.57 | 4.09 | 3.95 | 4.52 | 5.23 | Pass | 862 | 0.52 | 500 | | Inv. ex. |
| 55 | | | 1150 | 89 | 2.35 | 3.56 | 4.11 | 3.85 | 4.59 | 5.25 | Pass | 852 | 0.58 | 500 | | Inv. ex. |
| 56 | | | 1150 | 88 | 2.37 | 3.56 | 4.10 | 3.91 | 4.52 | 5.26 | Pass | 858 | 0.72 | 500 | | Inv. ex. |
| 57 | N | 707 | 1200 | 84 | 3.00 | 3.08 | 4.15 | 3.88 | 4.17 | 3.29 | Pass | 864 | 0.58 | 550 | | Inv. ex. |
| 58 | | | 1200 | 85 | 3.00 | 3.08 | 4.15 | 3.88 | 4.17 | 3.29 | Pass | 857 | 0.65 | 500 | | Inv. ex. |
| 59 | | | 1150 | 84 | 3.00 | 3.08 | 4.15 | 3.88 | 4.17 | 3.29 | Pass | 862 | 0.75 | 500 | | Inv. ex. |

TABLE 9

| Prod. No. | Steel | TS MPa | ⅙ sheet thickness part texture 1* | 2* | ½ sheet thickness part texture {332}<113> (A) | {112}<110> (B) | (A)/(B) | Static Young's modulus RD GPa | TD GPa | Dynamic Young's modulus RD GPa | TD GPa | Remarks |
|---|---|---|---|---|---|---|---|---|---|---|---|---|
| 54 | D | 560 | 0.0 | 8.4 | 4.3 | 8.1 | 0.53 | 222 | 231 | 235 | 230 | Inv. ex. |
| 55 | | 555 | 0.0 | 9.2 | 4.0 | 8.9 | 0.45 | 224 | 232 | 236 | 230 | Inv. ex. |
| 56 | | 562 | 0.0 | 9.8 | 4.0 | 9.3 | 0.43 | 225 | 232 | 238 | 233 | Inv. ex. |
| 57 | N | 546 | 1.3 | 9.2 | 4.6 | 8.3 | 0.55 | 223 | 234 | 236 | 235 | Inv. ex. |
| 58 | | 546 | 1.5 | 9.6 | 4.0 | 8.9 | 0.45 | 225 | 235 | 236 | 235 | Inv. ex. |
| 59 | | 552 | 0.0 | 10.2 | 4.2 | 9.5 | 0.44 | 227 | 236 | 238 | 236 | Inv. ex. |

1*: Sum of X-ray random intensity ratio of {100}<001> orientation and X-ray random intensity ratio of {110}<001> orientation 2*: Sum of maximum value of X-ray random intensity ratios of {110}<111> to {110}<112> orientation group and X-ray random intensity ratio of {211}<111> orientation

Example 4

Steel having the composition shown in Table 10 (balance of Fe and unavoidable impurities) was produced to produce a steel slab. The steel slab was heated, roughly rolled hot, then final rolled under the conditions shown in Table 11. The final rolling stand is comprised of six passes in total. The roll diameter was 700 to 830 mm. Further, the final strip thickness after the final pass was made 1.6 mm to 10 mm. The "–" of the column of formula 1 means a comparative example where no Ti is added.

From the obtained steel sheet, in the same way as Example 1, the tensile strength and Young's modulus were measured and the texture of the ⅙ sheet thickness part of the steel sheet was measured. Further, the X-ray random intensity ratios of the {332}<113> orientation and the {001}<110> orientation and {112}<110> orientation of the ½ sheet thickness part of the steel sheet, in the same way as the sample of the ⅙ sheet thickness part, were found from the ODF by X-ray diffraction using samples adjusted so that the ½ sheet thickness part became the measurement surface. Among these steel sheets, those hot dip galvanized after the end of hot rolling were indicated as "hot dip" and those hot dip galvannealed at 520° C. for 15 seconds were indicated as "alloy".

The results are shown in Table 12. As clear from Table 12, when hot rolling steel having the chemical ingredients of the present invention under suitable conditions, it was possible to make the Young's modulus by the static tension method over 220 GPa in both the rolling direction and rolling perpendicular orientation. In particular, it is learned that when the conditions of the texture of the sheet thickness center layer are simultaneously satisfied, the Young's modulus by the static tension method is high and the difference from the vibration method becomes smaller.

On the other hand, Production No. 78 is an example using the Steel AL with a small amount of Mn. The $Ar_3$ rises. As a result, the hot rolling is performed at $Ar_3$ or less, the concentration of the {110}<001> orientation rises, and the rolling direction Young's modulus falls. Further, the Production Nos. 79 and 80 are examples of Steel AO not containing and not satisfying formula 1 and Steel AP not containing Nb. The sum of the X-ray random intensity ratios of the {110}<111> to {110}<112> orientation group and the X-ray random intensity ratio of the {211}<111> orientation of the ⅙ sheet thickness part falls and the rolling direction Young's modulus falls.

Further, as shown in the comparative examples of Steels AA, AC, and AE, that is, Production Nos. 61, 64, and 67, if the number of passes where the shape ratio is 2.3 or more is small, even if a high Young's modulus is obtained by the vibration method, 220 GPa cannot be exceeded with the static tension method. Further, as shown in the comparative example of Steel AG, that is, Production No. 70, if the number of passes where the shape ratio is 2.3 or more is small and the rolling rate is low, the Young's moduli by the vibration method and static tension method fall below 220 GPa.

TABLE 10

| | Ingredients (mass %) C | Si | Mn | P | S | Al | N | Nb | Ti | B | Cr |
|---|---|---|---|---|---|---|---|---|---|---|---|
| AA | 0.052 | 0.61 | 1.68 | 0.007 | 0.0049 | 0.058 | 0.0018 | 0.034 | 0.032 | 0.0015 | 0.04 |
| AB | 0.049 | 0.01 | 1.22 | 0.009 | 0.0048 | 0.036 | 0.0027 | 0.013 | 0.023 | 0.0017 | 0.03 |
| AC | 0.034 | 0.01 | 1.62 | 0.010 | 0.0011 | 0.033 | 0.0020 | 0.043 | 0.035 | 0.0024 | |
| AD | 0.072 | 0.33 | 1.80 | 0.013 | 0.0041 | 0.041 | 0.0016 | 0.021 | 0.028 | 0.0009 | 0.02 |

TABLE 10-continued

| | | | | | | | | | | | |
|---|---|---|---|---|---|---|---|---|---|---|---|
| AE | 0.043 | 0.01 | 1.70 | 0.009 | 0.0038 | 0.035 | 0.0021 | 0.032 | 0.019 | 0.0023 | |
| AF | 0.050 | 0.01 | 1.20 | 0.013 | 0.0030 | 0.043 | 0.0022 | 0.035 | 0.017 | 0.0035 | |
| AG | 0.031 | 0.34 | 1.83 | 0.041 | 0.0052 | 0.040 | 0.0025 | 0.037 | 0.026 | 0.0026 | |
| AH | 0.118 | 0.58 | 1.78 | 0.012 | 0.0043 | 0.034 | 0.0037 | 0.029 | 0.034 | 0.0008 | 0.05 |
| AI | 0.145 | 1.21 | 1.38 | 0.011 | 0.0032 | 0.061 | 0.0026 | 0.034 | 0.041 | 0.0013 | 0.45 |
| AJ | 0.041 | 1.63 | 2.10 | 0.016 | 0.0039 | 0.035 | 0.0020 | 0.027 | 0.026 | 0.0014 | 0.04 |
| AK | 0.110 | 0.01 | 1.42 | 0.012 | 0.0042 | 0.037 | 0.0025 | 0.032 | 0.037 | | |
| AL | 0.041 | 0.12 | 0.80 | 0.008 | 0.0021 | 0.032 | 0.0019 | 0.023 | 0.020 | 0.0011 | 0.02 |
| AM | 0.044 | 0.08 | 2.95 | 0.010 | 0.0033 | 0.035 | 0.0018 | 0.018 | 0.015 | 0.0022 | 0.03 |
| AN | 0.040 | 1.60 | 0.08 | 0.012 | 0.0050 | 0.040 | 0.0020 | 0.030 | 0.015 | 0.0020 | 0.02 |
| AO | 0.062 | 0.01 | 1.36 | 0.032 | 0.0051 | 0.033 | 0.0021 | 0.036 | | | |
| AP | 0.081 | 0.60 | 1.48 | 0.007 | 0.0033 | 0.028 | 0.0023 | | 0.024 | | 0.03 |

| | Ingredients (mass %) | | | | | | | Ar3 | |
|---|---|---|---|---|---|---|---|---|---|
| | W | Cu | Ni | Mo | Ca, V, Rem | Form. 1 | Form. 2 | ° C. | Remarks |
| AA | | | | 0.16 | | 0.026 | 6.94 | 737 | Inv. ex. |
| AB | | 0.04 | | | | 0.014 | 4.67 | 772 | |
| AC | | 0.06 | 0.01 | | Ca: 0.0006 | 0.028 | 6.36 | 739 | |
| AD | 0.31 | | | | | 0.023 | 7.23 | 727 | |
| AE | | 0.02 | 0.01 | 0.20 | | 0.012 | 7.79 | 714 | |
| AF | | 0.28 | 0.14 | | | 0.009 | 9.92 | 748 | |
| AG | | 0.07 | 0.03 | 0.22 | Rem: 0.001 | 0.017 | 9.46 | 719 | |
| AH | | 0.03 | | | V: 0.022 | 0.021 | 6.29 | 718 | |
| AI | 0.18 | | | 0.07 | | 0.032 | 6.25 | 745 | |
| AJ | | | | 0.25 | | 0.019 | 9.15 | 729 | |
| AK | | 0.19 | 0.11 | | | 0.028 | 8.76 | 717 | |
| AL | | | | | | 0.013 | 2.57 | 821 | |
| AM | | 0.10 | 0.50 | 0.35 | | 0.009 | 17.78 | 556 | |
| AN | | 0.01 | 0.03 | | | 0.008 | 0.64 | 935 | Comp. ex. |
| AO | | | | | | — | 4.35 | 767 | |
| AP | | 0.02 | | | V: 0.007 | 0.016 | 5.13 | 758 | |

(Note)

Underlines indicate conditions outside range of present invention.

Formula 1: Ti − 48/14 × N

Formula 2: 3.2Mn + 9.6Mo + 4.7W + 6.2Ni + 18.6Cu + 0.7Cr

TABLE 11

| Production | | Ar3 | SRT | Rolling | Shape ratio | | | | | | | FT | CT | | |
|---|---|---|---|---|---|---|---|---|---|---|---|---|---|---|---|
| No | Steel | ° C. | ° C. | rate % | 1P | 2P | 3P | 4P | 5P | 6P | Pass/fail | ° C. | ° C. | Plating | Remarks |
| 60 | AA | 737 | 1200 | 76 | 2.32 | 2.93 | 4.19 | 4.12 | 4.19 | 3.51 | Pass | 816 | 450 | Hot dip | Inv. ex. |
| 61 | | | 1200 | 65 | 1.10 | 2.02 | 2.50 | 2.29 | 2.18 | 1.68 | Fail | 841 | 600 | | Comp. ex. |
| 62 | AB | 772 | 1250 | 63 | — | 2.43 | 2.38 | 2.25 | 2.08 | 1.53 | Pass | 860 | 500 | | Inv. ex. |
| 63 | AC | 739 | 1230 | 74 | 2.34 | 2.99 | 3.77 | 3.95 | 3.61 | 2.87 | Pass | 881 | 650 | Alloy | Inv. ex. |
| 64 | | | 1250 | 31 | — | — | 1.65 | 1.73 | 1.89 | 2.32 | Fail | 894 | 550 | | Comp. ex. |
| 65 | AD | 727 | 1200 | 68 | 2.12 | 2.46 | 2.76 | 2.55 | 2.09 | 2.02 | Pass | 860 | 350 | Alloy | Inv. ex. |
| 66 | AE | 714 | 1170 | 76 | 2.44 | 3.13 | 4.09 | 4.44 | 4.65 | 3.66 | Pass | 826 | 550 | | Inv. ex. |
| 67 | | | 1250 | 63 | — | — | — | 2.19 | 2.08 | 1.49 | Fail | 890 | 550 | | Comp. ex. |
| 68 | AF | 748 | 1230 | 79 | 2.81 | 3.70 | 4.61 | 5.57 | 6.40 | 5.85 | Pass | 872 | 500 | | Inv. ex. |
| 69 | AG | 719 | 1200 | 73 | 2.38 | 2.94 | 3.60 | 3.76 | 3.91 | 3.19 | Pass | 865 | 550 | | Inv. ex. |
| 70 | | | 1150 | 25 | 1.92 | 2.30 | 2.20 | 1.98 | 1.89 | 1.50 | Fail | 804 | 500 | | Comp. ex. |
| 71 | AH | 718 | 1130 | 65 | 2.02 | 2.53 | 2.40 | 2.20 | 2.14 | 1.67 | Pass | 823 | 500 | Hot dip | Inv. ex. |
| 72 | | | 1230 | 77 | 2.57 | 3.31 | 4.45 | 4.48 | 4.80 | 3.68 | Pass | 896 | 500 | | Inv. ex. |
| 73 | AI | 745 | 1200 | 77 | 2.57 | 3.29 | 4.57 | 4.99 | 5.18 | 4.27 | Pass | 860 | 650 | | Inv. ex. |
| 74 | AJ | 729 | 1250 | 79 | 2.57 | 3.43 | 4.98 | 5.12 | 5.75 | 4.74 | Pass | 888 | 550 | | Inv. ex. |
| 75 | AK | 717 | 1150 | 61 | 2.32 | 2.65 | 3.49 | 3.53 | 3.50 | 2.89 | Pass | 867 | 550 | | Inv. ex. |
| 76 | AL | 822 | 1170 | 77 | 2.51 | 3.42 | 4.49 | 5.23 | 5.01 | 3.65 | Pass | 852 | 550 | | Inv. ex. |
| 77 | AM | 533 | 1250 | 69 | 2.23 | 3.45 | 4.42 | 4.39 | 4.63 | 3.71 | Pass | 803 | 550 | | Inv. ex. |
| 78 | AN | 935 | 1170 | 77 | 2.51 | 3.45 | 4.59 | 5.13 | 4.96 | 3.71 | Pass | 830 | 550 | | Comp. ex. |
| 79 | AO | 767 | 1200 | 74 | 2.34 | 2.99 | 3.90 | 3.84 | 3.81 | 2.87 | Pass | 843 | 500 | | Comp. ex. |
| 80 | AP | 758 | 1170 | 74 | 2.18 | 2.75 | 3.57 | 3.57 | 3.52 | 2.63 | Pass | 810 | 450 | | Comp. ex. |

(Note)

Underlines are conditions outside range of present invention.

TABLE 12

| Prod. No. | Steel | TS MPa | ⅙ sheet thickness part texture 1* | ⅙ sheet thickness part texture 2* | ½ sheet thickness part texture (A) | (C) | (A)/(C) | Static Young's modulus RD GPa | Static Young's modulus TD GPa | Dynamic Young's modulus RD GPa | Dynamic Young's modulus TD GPa | Remarks |
|---|---|---|---|---|---|---|---|---|---|---|---|---|
| 60 | AA | 781 | 0.4 | 10.9 | 8.1 | 10.1 | 0.80 | 232 | 234 | 234 | 231 | Inv. ex. |
| 61 | | 688 | 0.9 | 4.5 | 4.6 | 6.3 | 0.73 | 212 | 221 | 231 | 229 | Comp. ex. |
| 62 | AB | 546 | 2.0 | 8.3 | 4.6 | 8.2 | 0.56 | 227 | 225 | 230 | 230 | Inv. ex. |
| 63 | AC | 600 | 0.2 | 7.4 | 4.3 | 8.6 | 0.50 | 225 | 232 | 230 | 230 | Inv. ex. |
| 64 | | 646 | 1.9 | 2.7 | 3.1 | 3.6 | 0.86 | 211 | 215 | 221 | 226 | Comp. ex. |
| 65 | AD | 651 | 1.2 | 8.6 | 7.7 | 9.6 | 0.80 | 226 | 232 | 234 | 232 | Inv. ex. |
| 66 | AE | 588 | 0.0 | 11.1 | 4.5 | 11.0 | 0.41 | 230 | 231 | 235 | 235 | Inv. ex. |
| 67 | | 590 | 0.1 | 1.3 | 9.1 | 7.5 | 1.21 | 215 | 234 | 230 | 236 | Comp. ex. |
| 68 | AF | 692 | 3.9 | 5.8 | 8.6 | 9.2 | 0.93 | 225 | 238 | 234 | 240 | Inv. ex. |
| 69 | AG | 737 | 1.0 | 8.3 | 8.4 | 7.7 | 1.09 | 226 | 230 | 241 | 231 | Inv. ex. |
| 70 | | 748 | 0.0 | 0.0 | 2.7 | 3.3 | 0.82 | 202 | 215 | 206 | 219 | Comp. ex. |
| 71 | AH | 663 | 1.0 | 14.5 | 8.0 | 10.5 | 0.76 | 235 | 230 | 237 | 231 | Inv. ex. |
| 72 | | 692 | 1.3 | 7.5 | 6.7 | 8.5 | 0.79 | 225 | 235 | 232 | 232 | Inv. ex. |
| 73 | AI | 657 | 1.5 | 9.1 | 8.0 | 9.5 | 0.84 | 226 | 236 | 231 | 235 | Inv. ex. |
| 74 | AJ | 981 | 1.1 | 7.3 | 9.3 | 10.3 | 0.90 | 228 | 233 | 236 | 236 | Inv. ex. |
| 75 | AK | 595 | 4.4 | 12.5 | 7.0 | 8.1 | 0.86 | 229 | 236 | 230 | 235 | Inv. ex. |
| 76 | AL | 548 | 2.8 | 5.1 | 3.4 | 4.6 | 0.74 | 221 | 229 | 231 | 234 | Inv. ex. |
| 77 | AM | 1128 | 0.0 | 14.7 | 15.2 | 11.3 | 1.35 | 220 | 238 | 245 | 242 | Inv. ex. |
| 78 | AN | 442 | 7.2 | 5.9 | 1.2 | 8.3 | 0.14 | 209 | 230 | 221 | 232 | Comp. ex. |
| 79 | AO | 521 | 4.3 | 2.8 | 7.3 | 10.5 | 0.70 | 214 | 232 | 235 | 231 | Comp. ex. |
| 80 | AP | 554 | 4.1 | 2.6 | 3.5 | 6.1 | 0.57 | 205 | 215 | 206 | 215 | Comp. ex. |

(Note)

Underlines are conditions outside range of present invention.

1*: Sum of X-ray random intensity ratio of {100}<001> orientation and X-ray random intensity ratio of {110}<001> orientation 2*: Sum of maximum value of X-ray random intensity ratios of {110}<111> to {110}<112> orientation group and X-ray random intensity ratio of {211}<111> orientation.

(A): X-ray random intensity ratio of {332}<113> orientation (C): Average value of X-ray random intensity ratios of {211}<110> and {100}<110> orientation

Example 5

Steels AA and AF shown in Table 10 were used for hot rolling under the conditions shown in Table 13. Production Nos. 82, 84, and 85 shown in Table 13 are examples of differential peripheral speed rolling changing the differential peripheral speed rates at the final three passes of the final rolling stand comprised of a total of six passes, that is, the fourth pass, fifth pass, and sixth pass. Note that the hot rolling conditions not shown in Table 13 are all similar to Example 4. Further, in the same way as Example 4, the tensile properties and textures of the ⅙ sheet thickness part and ½ sheet thickness part were measured and the Young's modulus was measured. The results are shown in Table 14.

As clear from this, when hot rolling steel having the chemical ingredients of the present invention under suitable conditions, if applying 1% or more differential peripheral speed rolling for one pass or more, formation of texture near the surface layer is promoted and furthermore the Young's modulus is improved.

TABLE 13

| Prod. No. | Steel | $Ar_3$ ° C. | SRT ° C. | Rolling rate % | Shape ratio 1P | 2P | 3P | 4P | 5P | 6P | Pass/fail | Differential peripheral speed rate (%) 4 pass | 5 pass | 6 pass | FT ° C. | CT ° C. | Plating | Remarks |
|---|---|---|---|---|---|---|---|---|---|---|---|---|---|---|---|---|---|---|
| 81 | AA | 737 | 1250 | 80 | — | 3.57 | 5.23 | 5.92 | 6.11 | 5.23 | Pass | 0 | 0 | 0 | 886 | 500 | | Inv. ex. |
| 82 | | | | 78 | 2.52 | 3.57 | 5.22 | 5.93 | 5.00 | 5.23 | Pass | 10 | 5 | 5 | 890 | 500 | Hot dip | Inv. ex. |
| 83 | AF | 748 | 1200 | 52 | 1.95 | 2.44 | 2.30 | 2.20 | 1.87 | 2.40 | Pass | 0 | 0 | 0 | 860 | 600 | | Inv. ex. |
| 84 | | | | 53 | 1.95 | 2.44 | 2.30 | 2.18 | 1.92 | 2.40 | Pass | 3 | 3 | 3 | 858 | 600 | Alloy | Inv. ex. |
| 85 | | | | 55 | 1.95 | 2.44 | 2.30 | 2.25 | 1.93 | 2.35 | Pass | 0 | 20 | 20 | 856 | 600 | | Inv. ex. |

TABLE 14

| Prod. No. | Steel | TS MPa | ⅙ sheet thickness part texture 1* | 2* | ½ sheet thickness part texture (A) | (C) | (A)/(C) | Static Young's modulus RD GPa | TD GPa | Dynamic Young's modulus RD GPa | TD GPa | Remarks |
|---|---|---|---|---|---|---|---|---|---|---|---|---|
| 81 | AA | 724 | 1.6 | 7.9 | 7.5 | 8.4 | 0.89 | 224 | 230 | 231 | 235 | Inv. ex. |
| 82 | | 734 | 1.0 | 13.8 | 7.2 | 8.4 | 0.86 | 237 | 235 | 239 | 236 | Inv. ex. |
| 83 | AF | 700 | 2.2 | 7.1 | 8.0 | 9.1 | 0.88 | 222 | 233 | 234 | 236 | Inv. ex. |
| 84 | | 711 | 1.7 | 9.1 | 6.6 | 7.1 | 0.93 | 231 | 238 | 237 | 238 | Inv. ex. |
| 85 | | 709 | 0.8 | 12.6 | 5.7 | 7.9 | 0.72 | 235 | 240 | 239 | 240 | Inv. ex. |

1*: Sum of X-ray random intensity ratio of {100}<001> orientation and X-ray random intensity ratio of {110}<001> orientation
2*: Sum of maximum value of X-ray random intensity ratios of {110}<111> to {110}<112> orientation group and X-ray random intensity ratio of {211}<111> orientation
(A): X-ray random intensity ratio of {332}<113> orientation
(C): Average value of X-ray random intensity ratios of {211}<110> and {100}<110> orientations

Example 6

Steels AB and AG shown in Table 10 were used for hot rolling while changing the effective strains $\epsilon^*$ as shown in Table 15. Note that the hot rolling conditions not shown in Table 15 are all similar to Example 4. Further, in the same way as Example 4, the tensile properties and textures of the ⅙ sheet thickness part and ½ sheet thickness part were measured and the Young's modulus was measured. The results are shown in Table 16.

As clear from this, when hot rolling steel having the chemical ingredients of the present invention under suitable conditions, if making the effective strain $\epsilon^*$ 0.4 or more, formation of texture near the surface layer is promoted and furthermore the Young's modulus is improved.

TABLE 15

| Prod. No. | Steel | $Ar_3$ ° C. | SRT ° C. | Rolling rate % | Shape ratio 1P | 2P | 3P | 4P | 5P | 6P | Pass/fail | FT ° C. | $\epsilon^*$ | CT ° C. | Plating | Remark |
|---|---|---|---|---|---|---|---|---|---|---|---|---|---|---|---|---|
| 86 | AB | 772 | 1250 | 88 | 2.37 | 3.57 | 4.09 | 3.95 | 4.52 | 5.23 | Pass | 861 | 0.51 | 500 | | Inv. ex. |
| 87 | | | 1150 | 89 | 2.35 | 3.56 | 4.11 | 3.85 | 4.59 | 5.25 | Pass | 851 | 0.57 | 500 | Hot dip | Inv. ex. |
| 88 | | | 1150 | 88 | 2.37 | 3.56 | 4.10 | 3.91 | 4.52 | 5.26 | Pass | 859 | 0.73 | 500 | | Inv. ex. |
| 89 | AG | 719 | 1200 | 84 | 3.00 | 3.08 | 4.15 | 3.88 | 4.17 | 3.29 | Pass | 863 | 0.59 | 550 | | Inv. ex. |
| 90 | | | 1200 | 85 | 3.00 | 3.08 | 4.15 | 3.88 | 4.17 | 3.29 | Pass | 858 | 0.64 | 500 | Alloy | Inv. ex. |
| 91 | | | 1150 | 84 | 3.00 | 3.08 | 4.15 | 3.88 | 4.17 | 3.29 | Pass | 863 | 0.76 | 500 | | Inv. ex. |

TABLE 16

| Prod. No. | Steel | TS MPa | ⅙ sheet thickness part texture 1* | 2* | ½ sheet thickness part texture (A) | (C) | (A)/(C) | Static Young's modulus RD GPa | TD GPa | Dynamic Young's modulus RD GPa | TD GPa | Remarks |
|---|---|---|---|---|---|---|---|---|---|---|---|---|
| 86 | AB | 561 | 0.0 | 8.5 | 4.2 | 8.0 | 0.53 | 221 | 230 | 234 | 229 | Inv. ex. |
| 87 | | 556 | 0.0 | 9.3 | 3.9 | 8.8 | 0.44 | 223 | 231 | 235 | 231 | Inv. ex. |
| 88 | | 561 | 0.0 | 9.9 | 3.9 | 9.4 | 0.41 | 226 | 231 | 239 | 231 | Inv. ex. |
| 89 | AG | 548 | 1.2 | 9.1 | 4.5 | 9.2 | 0.55 | 222 | 233 | 235 | 233 | Inv. ex. |
| 90 | | 545 | 1.4 | 9.7 | 4.1 | 9.0 | 0.45 | 224 | 234 | 237 | 234 | Inv. ex. |
| 91 | | 551 | 0.0 | 10.1 | 4.2 | 9.3 | 0.45 | 228 | 235 | 239 | 237 | Inv. ex. |

1*: Sum of X-ray random intensity ratio of {100}<001> orientation and X-ray random intensity ratio of {110}<001> orientation
2*: Sum of maximum value of X-ray random intensity ratios of {110}<111> to {110}<112> orientation group and X-ray random intensity ratio of {211}<111> orientation
(A): X-ray random intensity ratio of {332}<113> orientation
(C): Average value of X-ray random intensity ratios of {211}<110> and {100}<110> orientations

INDUSTRIAL APPLICABILITY

The high Young's modulus steel sheet of the present invention is used for automobiles, household electrical appliances, buildings, etc. Further, the high Young's modulus steel sheet of the present invention includes hot rolled steel sheet in the narrow sense on which no surface treatment is performed and hot rolled steel sheet in the broad sense on which surface treatment for rust prevention such as hot dip galvanization, hot dip galvannealization, and electroplating is performed. The surface treatment includes aluminum-based plating, formation of organic coatings and inorganic coatings on the surfaces of hot rolled steel sheet and various types of plated steel sheet, painting, and combinations of the same.

The steel sheet of the present invention has a high Young's modulus, so it is possible to reduce the sheet thickness from conventional steel sheet, that is, possible to lighten the weight and contribute to protection of the global environment. Further, the steel sheet of the present invention is improved in shape fixability as well, so application of high strength steel sheet to automobile members and other pressed parts becomes easy. Furthermore, a member obtained by shaping and working the steel sheet of the present invention is superior in impact energy absorption characteristic, so improvement of the safety of automobiles is also contributed to.

The invention claimed is:

1. High Young's modulus steel sheet containing, by mass %,

C: 0.005 to 0.200%,
Si: 2.50% or less,
Mn: 0.10 to 3.00%,
P: 0.150% or less,
S: 0.0150% or less,
Al: 0.150% or less,
N: 0.0100% or less,
Nb: 0.005 to 0.100%, and
Ti: 0.002 to 0.150%, satisfying the formula 1, having a balance of Fe and unavoidable impurities, having a sum of an X-ray random intensity ratio of the {100}<001> orientation and an X-ray random intensity ratio of the {110}<001> orientation of 5 or less at a position of a direction from the surface of the steel sheet in the sheet thickness direction of ⅙ of the sheet thickness, and having a sum of a maximum value of the X-ray random intensity ratios of the {110}<111> to {110}<112> orientation group and a X-ray random intensity ratio of the {211}<111> orientation of 5 or more:

$$Ti-48/14\times N \geqq 0.0005 \qquad \text{formula 1}$$

where, Ti and N are the contents (mass %) of the elements.

2. A high Young's modulus steel sheet as set forth in claim 1 characterized by further containing, by mass %, one or more of Mo: 0.01 to 1.00%,
Cr: 0.01 to 3.00%,
W: 0.01 to 3.00%,
Cu: 0.01 to 3.00%, and
Ni: 0.01 to 3.00%.

3. A high Young's modulus steel sheet as set forth in claim 2 characterized by satisfying the following formula 2:

$$4 \leqq 3.2Mn+9.6Mo+4.7W+6.2Ni+18.6Cu+0.7Cr \leqq 10 \qquad \text{formula 2}$$

where, Mn, Mo, W, Ni, Cu, and Cr are the contents (mass %) of the elements.

4. A high Young's modulus steel sheet as set forth in claim 1 characterized by further containing, by mass %, B: 0.0005 to 0.0100%.

5. A high Young's modulus steel sheet as set forth in claim 1 characterized by further containing, by mass %, one or more of Ca: 0.0005 to 0.1000%,
Rem: 0.0005 to 0.1000%, and
V: 0.001 to 0.100%.

6. A high Young's modulus steel sheet as set forth in claim 1 characterized by having an X-ray random intensity ratio of the {332}<113> orientation (A) of 15 or less and an X-ray random intensity ratio of the {225}<110> orientation (B) of 5 or more at a center part of the steel sheet in the sheet thickness direction and satisfying (A)/(B)≦1.00.

7. A high Young's modulus steel sheet as set forth in claim 1 characterized by having an X-ray random intensity ratio of the {332}<113> orientation (A) of 15 or less and a simple average of an X-ray random intensity ratio of the {001}<110> orientation and an X-ray random intensity ratio of the {112}<110> orientation (C) of 5 or more at a center part of the steel sheet in the sheet thickness direction and satisfying (A)/(C)≦1.10.

8. A high Young's modulus steel sheet as set forth in claim 1 characterized by having a rolling direction Young's modulus measured by the static tension method of 220 GPa or more.

9. A hot dip galvanized steel sheet characterized by comprising a high Young's modulus steel sheet as set forth in claim 1 which is hot dip galvanized.

10. A hot dip galvannealed steel sheet characterized by comprising a high Young's modulus steel sheet as set forth in claim 1 which is hot dip galvannealed.

11. A method of production of high Young's modulus steel sheet characterized by rolling a steel slab having the chemical ingredients as set forth in claim 1 at 1100° C. or less by a rolling rate until the final pass of 40% or more and by a shape ratio X found by the following formula 3 of 2.3 or more by two passes or more, hot rolling at a temperature of the final pass of the $Ar_a$ transformation point to 900° C., and coiling at 700° C. or less:

$$\text{Shape ratio } X=l_d/h_m \qquad \text{formula 3}$$

where, $l_d$ (contact arc length of rolling rolls and steel plate): $\sqrt{(L\times(h_{in}-h_{out})/2)}$ ld: $(h_{in}+h_{out})/2$ L: diameter of rolling rolls $h_{in}$: sheet thickness of rolling roll entry side $h_{out}$: sheet thickness of rolling roll exit side.

12. A method of production of high Young's modulus steel sheet as set forth in claim 11 characterized by hot rolling so that the effective strain $\epsilon^*$ calculated by the following formula 5 becomes 0.4 or more:

$$\varepsilon^* = \sum_{j=1}^{n-1} \varepsilon_j \exp\left[-\sum_{i=j}^{n-1}\left(\frac{t_i}{\tau_i}\right)^{2/3}\right] + \varepsilon_n \qquad \text{formula 5}$$

where, n is a number of rolling stands of final hot rolling, $\epsilon_j$ is a strain given at a j-th stand, $\epsilon_n$ is a strain given at an n-th stand, t, is a travel time (s) between an i-th to i+1st stands, and $\tau_i$ is calculated by the following formula 6 by a gas constant R (=1.987) and a rolling temperature $T_i$(K) of an i-th stand:

$$\tau_i = 8.46 \times 10^{-9} \exp\left(\frac{43800}{R \times Ti}\right) \quad \text{formula 6}$$

13. A method of production of high Young's modulus steel sheet as set forth in claim 11 characterized by making a differential peripheral speed rate of at least one pass of hot rolling 1% or more.

14. A method of production of high Young's modulus steel sheet characterized by hot dip galvanizing a surface of steel sheet produced by the method as set forth in claim 11.

15. A method of production of hot dip galvannealized steel sheet characterized by hot dip galvanizing a surface of steel sheet produced by a method as set forth in claim 11, then heat treating it in a temperature range from 450 to 600° C. for 10 seconds or more.

* * * * *

UNITED STATES PATENT AND TRADEMARK OFFICE

CERTIFICATE OF CORRECTION

PATENT NO. : 8,353,992 B2
APPLICATION NO. : 12/312325
DATED : January 15, 2013
INVENTOR(S) : Natsuko Sugiura et al.

It is certified that error appears in the above-identified patent and that said Letters Patent is hereby corrected as shown below:

In the Specifications

Column 4, line 37, change "$\epsilon$*" to -- $\varepsilon$* --;

Column 4, line 46, change "$\epsilon_j$" to -- $\varepsilon_j$ --;

Column 4, line 47, change "$\epsilon_n$" to -- $\varepsilon_n$ --;

Column 9, line 26, change " to 550" to -- to 55° --;

Column 9, line 48, change "( =0 to 180°," to -- $\Phi$ =0 to 180°, --;

Column 10, line 11, change "{100} 001>" to -- {100} <001> --;

Column 10, line 56, change "{112} 110>" to -- {112} <110> --;

Column 14, line 2, change "the y-phase" to -- the $\gamma$-phase --;

Column 16, line 37, change "$\epsilon$*" to -- $\varepsilon$* --;

Column 16, line 47, change "$\epsilon_j$" to -- $\varepsilon_j$ --;

Column 16, line 47, change "$\epsilon_n$" to -- $\varepsilon_n$ --;

Column 16, line 49, change "$T_i$" to -- $\tau_i$ --;

Column 16, line 57, change "$\epsilon$*" to -- $\varepsilon$* --;

Column 16, line 61, change "$\epsilon$*" to -- $\varepsilon$* --;

Column 16, line 65, change "$\epsilon$*" to -- $\varepsilon$* --;

Column 28, line 5, change "$\epsilon$*" to -- $\varepsilon$* --;

Signed and Sealed this
Seventeenth Day of December, 2013

Margaret A. Focarino

Margaret A. Focarino
*Commissioner for Patents of the United States Patent and Trademark Office*

Column 28, line 18, change "$\epsilon$*" to -- $\varepsilon$* --;

Column 30, in Table 8, change "$\epsilon$*" to -- $\varepsilon$* --;

Column 35, line 23, change "$\epsilon$*" to -- $\varepsilon$* --;

Column 35, line 31, change "$\epsilon$*" to -- $\varepsilon$* --;

Column 36 in Table 15, change "$\epsilon$*" to -- $\varepsilon$* --;

In the Claims

Claim 11, Column 38, line 39, change "$Ar_a$" to -- $Ar_3$ --;

Claim 12, Column 38, line 53, change "$\epsilon$*" to -- $\varepsilon$* --;

Claim 12, Column 38, line 62, change "$\epsilon_j$" to -- $\varepsilon_j$ --;

Claim 12, Column 38, line 63, change "$\epsilon_n$" to -- $\varepsilon_n$ --;

Claim 12, Column 38, line 64, change "t," to -- $t_i$ --.